US012102174B2

(12) United States Patent
McLachlan et al.

(10) Patent No.: US 12,102,174 B2
(45) Date of Patent: Oct. 1, 2024

(54) FOOT SUPPORT COMPONENTS FOR ARTICLES OF FOOTWEAR INCLUDING MULTIPLE FLEXIBLE PROJECTIONS AT THE GROUND-FACING SURFACE

(71) Applicant: NIKE, Inc., Beaverton, OR (US)

(72) Inventors: Oliver McLachlan, Beaverton, OR (US); Krissy Yetman, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 0 days.

(21) Appl. No.: 17/089,091

(22) Filed: Nov. 4, 2020

(65) Prior Publication Data

US 2021/0127785 A1 May 6, 2021

Related U.S. Application Data

(60) Provisional application No. 62/930,890, filed on Nov. 5, 2019.

(51) Int. Cl.
*A43B 13/22* (2006.01)

(52) U.S. Cl.
CPC ..... *A43B 13/22* (2013.01)

(58) Field of Classification Search
CPC ..... A43B 13/22; A43B 13/26; A43B 13/184
See application file for complete search history.

(56) References Cited

U.S. PATENT DOCUMENTS 2,985,971 A * 5/1961 Murawski ..... A43B 13/184 36/3 R
3,463,165 A * 8/1969 Goodman ..... A43B 7/00 36/142
3,555,697 A * 1/1971 Dassler ..... A43B 5/06 36/129
3,583,082 A * 6/1971 Jordan, Jr. ..... A43D 100/14 36/129

(Continued)

FOREIGN PATENT DOCUMENTS

EP 2420152 A2 2/2012
KR 20130023868 A 3/2013

OTHER PUBLICATIONS

Feb. 12, 2021—(WO) ISR & WO—App. No. PCT/US2020/059051.

*Primary Examiner* — Alissa J Tompkins
*Assistant Examiner* — Raquel M. Weis
(74) *Attorney, Agent, or Firm* — Banner & Witcoff, Ltd.

(57) ABSTRACT

Foot support components for footwear include a sole member made from one or more parts and including a base surface. A plurality of medial side primary traction elements (e.g., soccer cleats) and a plurality of lateral side primary traction elements (e.g., soccer cleats) extend in a direction away from the base surface. A central space is defined between interior extents (e.g., interior-most surfaces) of the plurality of medial and lateral side primary traction elements, and this central space may be free of primary traction elements (e.g., free of cleats). A projection field comprising (Continued)

a plurality of projections is located at least partially in the central space. These projections can readily bend under the weight of the user and help provide better "feel" for a ball, e.g., by transmitting force from the ball to the wearer's foot and providing audible feedback when contacting the ball.

18 Claims, 13 Drawing Sheets

(56) References Cited

U.S. PATENT DOCUMENTS 3,722,113 A * 3/1973 Birkenstock ..... A43B 7/142 36/43
3,757,774 A * 9/1973 Hatuno ..... A61H 7/001 36/141
3,849,915 A * 11/1974 Inohara ..... A43B 5/00 36/67 B
3,932,950 A * 1/1976 Taber ..... A43B 13/223 36/32 R
4,202,116 A * 5/1980 Dassler ..... A43B 13/26 36/59 A
4,327,503 A * 5/1982 Johnson ..... A43B 13/223 36/129
4,356,643 A * 11/1982 Kester ..... A43B 13/22 36/59 C
4,375,728 A * 3/1983 Dassler ..... A43B 13/223 36/114
4,378,643 A * 4/1983 Johnson ..... A43B 13/223 36/129
4,402,145 A * 9/1983 Dassler ..... A43B 13/223 36/129
4,439,936 A * 4/1984 Clarke ..... A43B 13/26 36/102
4,527,345 A * 7/1985 Lopez Lopez ..... A43B 13/26 36/31
4,624,062 A * 11/1986 Autry ..... A43B 13/223 D2/951
5,077,916 A * 1/1992 Beneteau ..... A43B 13/184 36/31
5,265,354 A * 11/1993 Aliano, Jr. ..... A43B 13/14 36/43
5,293,701 A * 3/1994 Sullivan ..... A43C 15/164 36/114
5,313,718 A * 5/1994 McMahon ..... A43B 3/0042 36/31
5,483,760 A * 1/1996 Kataoka ..... A43C 15/02 36/129
5,533,282 A * 7/1996 Kataoka ..... A43B 13/26 36/129
5,761,833 A * 6/1998 McMullin ..... A43B 13/36 36/62
5,775,005 A * 7/1998 McClelland ..... A43B 13/184 36/31
5,836,091 A * 11/1998 Cook ..... A43C 15/02 2/160
6,032,386 A * 3/2000 Evans ..... A43B 5/185 36/15
6,076,283 A * 6/2000 Boie ..... A43B 13/223 D2/951
6,948,264 B1 * 9/2005 Lyden ..... A43B 5/02 D2/951
7,287,343 B2 * 10/2007 Healy ..... A43B 13/223 D2/908
7,370,439 B1 * 5/2008 Myers ..... A43B 13/26 36/31
7,762,009 B2 * 7/2010 Gerber ..... A43B 13/26 36/59 C
9,210,967 B2 * 12/2015 Gerber ..... A43B 13/12
9,532,623 B2 * 1/2017 Kilgore ..... A43B 13/14
10,172,417 B2 * 1/2019 Hoffer ..... A43B 13/141
2004/0163282 A1 * 8/2004 Pan ..... A43B 13/223 36/59 R
2006/0005426 A1 * 1/2006 Votolato ..... A43B 13/16 36/7.3
2007/0130801 A1 * 6/2007 Wu ..... A43B 13/26 36/59 R
2007/0199211 A1 * 8/2007 Campbell ..... A43C 15/162 36/102
2008/0201992 A1 * 8/2008 Avar ..... A43B 13/16 12/146 B
2008/0209766 A1 * 9/2008 Braunschweiler ... A43B 13/183 36/102
2008/0222921 A1 * 9/2008 Gerber ..... A43B 3/0042 36/103
2009/0090031 A1 * 4/2009 Jung ..... A43B 13/14 36/59 C
2012/0023781 A1 * 2/2012 Dojan ..... A43B 13/122 36/103
2012/0036740 A1 * 2/2012 Gerber ..... A43B 13/026 36/134
2014/0096414 A1 * 4/2014 Koo ..... B29C 43/28 36/103
2015/0096194 A1 * 4/2015 Horton ..... A43D 100/14 36/62
2016/0192739 A1 * 7/2016 Hoffer ..... A43B 13/188 36/28

* cited by examiner

FOOT SUPPORT COMPONENTS FOR ARTICLES OF FOOTWEAR INCLUDING MULTIPLE FLEXIBLE PROJECTIONS AT THE GROUND-FACING SURFACE

RELATED APPLICATION DATA

This application claims priority benefits to and is a U.S. Non-Provisional patent application based on U.S. Provisional Patent Appln. No. 62/930,890 filed Nov. 5, 2019. U.S. Provisional Patent Appln. No. 62/930,890 is entirely incorporated herein by reference.

FIELD OF THE INVENTION

The present technology relates to the field of footwear. Aspects of the present technology pertain to foot support components (e.g., sole structures and/or components of sole structures) for articles of footwear that include multiple flexible projections at their ground-facing surfaces.

BACKGROUND

Conventional articles of athletic footwear include two primary elements, an upper and a sole structure. The upper provides a covering for the foot that securely receives and positions the foot with respect to the sole structure. In addition, the upper may have a configuration that protects the foot and provides ventilation, thereby cooling the foot and removing perspiration. The sole structure is secured to a lower surface of the upper and is generally positioned between the foot and any contact surface. In addition to attenuating ground reaction forces and absorbing energy, the sole structure may provide traction and control potentially harmful foot motion, such as over pronation. General features and configurations of uppers and sole structures are discussed in greater detail below.

The upper forms a void on the interior of the footwear for receiving the foot. The void has the general shape of the foot, and access to the void is provided at an ankle or foot-insertion opening. Accordingly, the upper extends over the instep and toe areas of the foot, along the medial and lateral sides of the foot, and around the heel area of the foot. A lacing system often is incorporated into the upper to selectively change the size of the ankle opening and to permit the wearer to modify certain dimensions of the upper, particularly girth, to accommodate feet with varying proportions. In addition, the upper may include a tongue that extends under the lacing system to enhance the comfort of the footwear (e.g., to modulate pressure applied to the foot by the laces), and the upper also may include a heel counter to limit or control movement of the heel.

The sole structure generally incorporates multiple layers that are conventionally referred to as an "insole," a "midsole," and an "outsole." The insole (which also may constitute a sock liner) is a thin member located within the upper and adjacent the plantar (lower) surface of the foot to enhance footwear comfort, e.g., to wick away moisture. The midsole, which is traditionally attached to the upper along the upper's entire length, forms the middle layer of the sole structure and serves a variety of purposes that include controlling foot motions and attenuating impact forces. The outsole forms the ground-contacting element of footwear and usually is fashioned from a durable, wear-resistant material that includes texturing or other features to improve traction.

Terminology

Some general terminology and information is provided that will assist in understanding various portions of this specification and the invention(s) as described herein. As noted above, the present technology relates to the field of footwear. "Footwear" means any type of wearing apparel for the feet, and this term includes, but is not limited to: all types of shoes, boots, sneakers, sandals, thongs, flip-flops, mules, scuffs, slippers, sport-specific shoes (such as golf shoes, tennis shoes, baseball cleats, soccer or football cleats, ski boots, basketball shoes, cross training shoes, track shoes, track field event shoes (e.g., for high jump, triple jump, etc.), etc.), and the like.

The term "projection" as used herein means a component or part that extends from another part (e.g., a base surface); has an exposed free end; has a length dimension L extending from its origin point (e.g., at the base surface or other part) to the exposed free end of at least 4 mm; and has a transverse cross sectional dimension CS (transverse to its length dimension, such as a diameter, diagonal, etc.) that is less than the length dimension L over at least 50% of the length dimension L. In some examples of this technology, a "projection" may have any one or more of the following "length-to-cross sectional dimension" features: (a) L=1×CS to 100×CS; (b) L=1.1×CS to 90×CS; (c) L=1.2×CS to 80×CS; (d) L=1.5×CS to 70×CS; (e) L=2×CS to 60×CS; and/or (f) L=2.5×CS to 50×CS. "Projections" may have any desired transverse cross sectional shape, such as round, circular, oval, elliptical, polygonal, rectangular, square, rounded rectangular, cross, star, irregularly shaped, etc. Furthermore, a "projection" may have any of the above noted length-to-cross sectional dimension features over a portion of its overall length dimension, such as over at least 50% of the length dimension L, over at least 75% of the length dimension L, over at least 85% of the length dimension L, over at least 90% of the length dimension L, over at least 95% of the length dimension L, over at least 98% of the length dimension L, or even over the entire length dimension L. In such examples, the "projection" may have the noted length-to-cross sectional dimension features over a portion of its overall length dimension measured from its free end.

The terms "field of projections" or "projection field" as used herein are interchangeable and mean a region of a sole structure that contains multiple projections of the types described above located within (e.g., dispersed over) its area. In some examples, each projection within the "field" may be located within a distance of 15 mm or less from another projection. In other words, in at least some examples, a "field of projections" or "projection field" may constitute the collection of projections (as defined above) located within 15 mm of at least one other projection. In some examples, the "field of projections" or "projection field" will be formed as a separate part that is engaged with other components of a sole structure. The projections may be regularly dispersed over the area of the projection field (e.g., have a substantially constant packing density of "x" projections per square inch) or the projections may have a varying packing density over the area of the projection field. A projection field may contain projections of the same or different sizes and/or shapes. A "field of projections" or a "projection field" may be integrally formed with another sole part (e.g., an outsole component) or it may be a separate part attached to another sole part or footwear part.

Further potential properties of "projection fields" in accordance with at least some aspects of this technology are described below. A "projection field" in accordance with at least some examples of this technology may include any area of a sole structure that includes a projection packing density of at least 4 projections (of the types described above) per square inch (at least 0.62 projections per square centimeter). At least some projection fields in accordance with aspects of this technology may include an area of 900 $mm^2$ to 8000 $mm^2$ having an average projection packing density within that area (i.e., the total number (N) of projections divided by the total area of the projection field or "projections per unit area") of at least 4 projections (of the types described above) per square inch (at least 0.62 projections per square centimeter). As some additional examples, some projection fields in accordance with aspects of this technology may include an area of 900 $mm^2$ to 8000 $mm^2$ having an average projection packing density within that area (i.e., projections per unit area) and/or a total number of projections (N) within that area of one or more of: (a) at least 6 projections per square inch (at least 0.93 projections per square centimeter); (b) at least 8 projections per square inch (at least 1.24 projections per square centimeter); (c) 3 to 24 projections per square inch (0.47 to 3.72 projections per square centimeter); (d) 4 to 20 projections per square inch (0.62 to 3.1 projections per square centimeter); (e) 6 to 16 projections per square inch (0.93 to 2.48 projections per square centimeter); (f) at least 20 projections within the projection field area; (g) at least 35 projections within the projection field area; (g) at least 50 projections within the projection field area; (h) from 20 to 250 projections within the projection field area; (i) from 35 to 225 projections within the projection field area; (j) from 50 to 200 projections within the projection field area; (j) from 20 to 120 projections within the projection field area; (k) from 30 to 90 projections within the projection field area; and/or (1) from 35 to 75 projections within the projection field area. The various different ranges of average projection packing densities and/or total numbers of projections listed above also may be provided within areas of: (a) at least 900 $mm^2$; (b) at least 1200 $mm^2$; (c) at least 1600 $mm^2$; (d) from 900 $mm^2$ to 5000 $mm^2$; (e) from 1200 $mm^2$ to 4000 $mm^2$; (f) from 1600 $mm^2$ to 3600 $mm^2$; (g) from 1200 $mm^2$ to 6000 $mm^2$; and/or (h) from 1600 $mm^2$ to 5000 $mm^2$. A "projection field" may have any one or more and/or any combination of the properties described above.

The term "majority" as used herein, means any amount "more than 50%."

SUMMARY OF THE INVENTION

Foot support components include multiple flexible projections at their ground-facing surfaces, e.g., located in a field of projections. These projections may assist athletes in sports that include contact and/or control of a ball with the bottom of a foot, such as soccer/global football. As some more specific examples, the projections may assist in one or more of: gripping the ball, transmitting "feel" of the ball through the sole to the wearer's foot (e.g., producing proprioceptive benefits), and/or providing tactile and/or audio feedback confirming contact with the ball.

BRIEF DESCRIPTION OF THE DRAWINGS

The foregoing Summary, as well as the following Detailed Description, will be better understood when read in conjunction with the accompanying drawings in which like reference numerals refer to the same or similar elements in all of the various views in which that reference number appears.

Figure 1A:
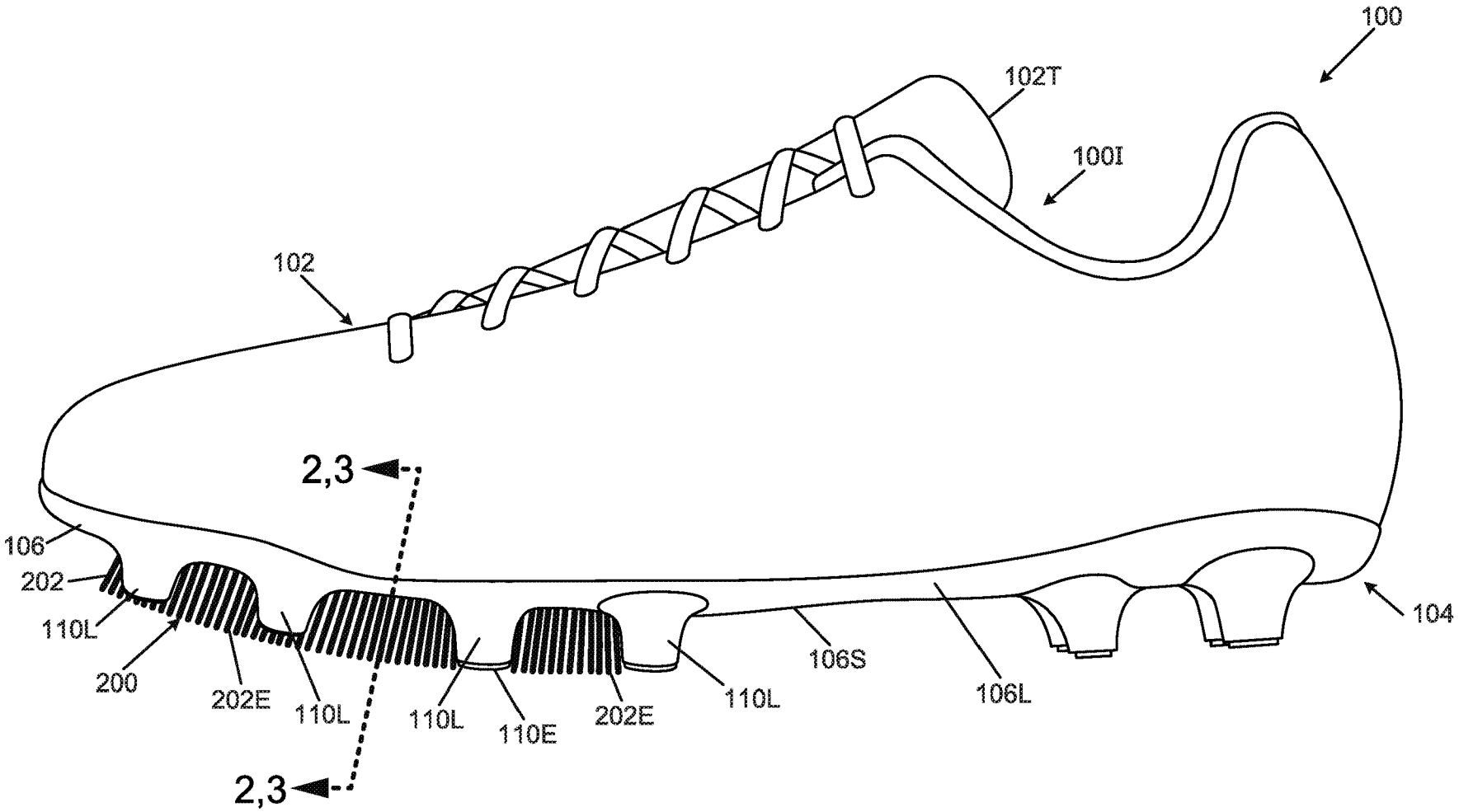
FIGS. 1A through 1D provide various views of an article of footwear and sole structure in accordance with aspects of this technology.

The reader should understand that the attached drawings are not necessarily drawn to scale.

DETAILED DESCRIPTION

In the following description of various examples of footwear structures and components according to the present technology, reference is made to the accompanying drawings, which form a part hereof, and in which are shown by way of illustration various example structures and environments in which aspects of the invention may be practiced. It is to be understood that other structures and environments may be utilized and that structural and functional modifications may be made from the specifically described structures and functions without departing from the scope of the present invention.

I. DETAILED DESCRIPTION OF EXAMPLE FOOT SUPPORT COMPONENTS AND/OR ARTICLES OF FOOTWEAR ACCORDING TO THIS INVENTION

Referring to the figures and following discussion, various foot support components, articles of footwear, and features thereof in accordance with aspects of the present invention are disclosed. Concepts disclosed with respect to these components and footwear may be applied with particular benefit to soccer/global football shoes, including "small sided soccer" activities, e.g., played on smaller fields where trapping the ball with the foot and more controlled movement of the ball is beneficial. Aspects of the invention may be applied to other footwear styles and specific sports as well.

Foot support components for articles of footwear according to some aspects of this technology include a sole structure having a ground-facing surface and an upper-facing surface. The sole structure includes a sole member made from one or more parts and including a base surface, a medial side, and a lateral side. A plurality of medial side primary traction elements (e.g., soccer cleats) may be located on the medial side of the sole member and may extend in a direction away from the base surface, and a plurality of lateral side primary traction elements (e.g., soccer cleats) may be located on the lateral side of the sole member and may extend in a direction away from the base surface. A central space may be defined between interior extents (e.g., interior-most surfaces) of the plurality of medial side primary traction elements and the plurality of lateral side primary traction elements, and this central space may be free of primary traction elements (e.g., free of cleats). In accordance with aspects of this technology, a projection field comprising a plurality of projections is located at least partially in the central space.

The projection field comprises a plurality of projections that may have a wide variety of features and/or characteristics, as will be described in more detail below. As some more specific examples, the projection field and/or at least some of the projections in the projection field may have a combination of two or more of the parameter values set forth in any one or more of Table 1, Table 2, and/or Table 3 below. If desired, a single sole structure may include two or more discrete projection fields.

As some additional or alternative examples, the projection field may include a plurality of projections (e.g., at least 20 projections) that extend beyond the base surface of the sole structure and have exposed free ends. The projection field may define an area of at least 900 $mm^2$, e.g., with projections dispersed throughout (e.g., with a constant packing density or a varying packing density), and at least a portion of this projection field includes a projection packing density of at least 4 projections per square inch (0.62 projections per square centimeter). A first subset of the plurality of projections may have a length of at least 5 mm, at least 6 mm, or even at least 8 mm, and at least a majority of the plurality of projections in the projection field will readily bend under force applied by weight of a user of the sole structure. In some examples, at least 70%, at least 75%, at least 80%, at least 85%, at least 90%, at least 95%, or even all of the plurality of projections in the projection field will readily bend under force applied by weight of a user of the sole structure (i.e., when contacting the ground).

As yet additional or alternative examples, the projection field may include a plurality of projections (e.g., at least 20 projections) that extend beyond the base surface of the sole structure and have exposed free ends. At least a majority of the projections of this projection field will readily bend under force applied by weight of a user of the sole structure (and in some examples, at least 70%, at least 75%, at least 80%, at least 85%, at least 90%, at least 95%, or even all of the plurality of projections in the projection field will readily bend under force applied by weight of a user of the sole structure). In such structures, with the sole structure supported on its ground-facing surface on a horizontal support surface, a first subset of the plurality of projections will have a sufficient longitudinal length L (at least when fully extended) to have their free ends extend toward the horizontal support surface (and away from the base surface of the sole member) beyond the free end of a closest primary traction element to the respective projection of the first subset.

Still additional aspects of this technology relate to methods of making footwear components and/or articles of footwear containing them, e.g., of the types and having the structures described above (and described in more detail below).

Given the above background and general description of aspects and examples of this technology, a more detailed description of specific examples of articles of footwear in accordance with at least some examples of this technology and this invention follows.

II. DETAILED DESCRIPTION OF SPECIFIC EXAMPLE FOOT SUPPORT COMPONENTS AND/OR ARTICLES OF FOOTWEAR ACCORDING TO THIS INVENTION

FIGS. 1A-1D provide various views of an article of footwear 100 containing sole structures 104 in accordance with at least some aspects of this technology. The term "sole structure" as used herein may include any one or more foot support parts, e.g., forming the entirety and/or a portion of an overall sole for an article of footwear 100. Such "foot support parts" may include, for example, any individual part and/or combination of two or more foot support parts described in the examples below and shown in the figures. Various features, characteristics, and/or parts of example articles of footwear 100 and sole structures 104 thereof are described in more detail below.

The article of footwear 100 of FIG. 1A includes an upper 102 and a sole structure 104 engaged with the upper 102. The upper 102 and sole structure 104 may be engaged together in any desired manner, including in manners conventionally known and used in the footwear arts (such as by one or more of adhesives or cements, stitching or sewing, mechanical connectors, etc.).

The upper 102, potentially together with the sole structure 104, define a foot-receiving interior chamber 100I for containing a wearer's foot. The bottom of the upper 102 may include a strobel 108 or other component engaged with or integrally formed with another portion of the upper 102, e.g., a lateral side upper component 102L and/or a medial side upper component 102M (see FIGS. 2 and 3). The upper 102 may include other components as well. For example, the upper 102 may include a tongue member 102T located across the foot instep area and positioned to moderate the feel of the footwear's closure system on the wearer's foot; a closure system (e.g., including one or more of a lace type closure system, a zippered closure system, a buckle type closure system, elastic stretch elements, etc.); a heel counter; a toe cap; straps; etc. Additionally or alternatively, the upper 102 may include a "sock-like" upper component, e.g., made from fabric and configured to closely fit the wearer's foot like a conventional sock.

The upper 102 may be made from any desired material(s) and/or in any desired constructions and/or manners without departing from this technology. As some more specific examples, all or at least a portion of the upper 102 (and optionally a majority, substantially all, or even all of the upper 102) may be formed as a woven textile component, a knitted textile component, another textile component, a natural leather component, a synthetic leather component, a polymeric component (e.g., a thermoplastic polyurethane [TPU], etc.), etc. The components for upper 102 may have structures and/or constructions like those used in footwear products commercially available from NIKE, Inc. of Beaverton, OR and/or other manufacturers, including conventional structures and constructions (e.g., for soccer/global football shoes), as are known and used in the art.

Additionally or alternatively, if desired, the upper 102 construction may include uppers having foot securing and engaging structures (e.g., "dynamic" and/or "adaptive fit" structures), e.g., of the types described in U.S. Patent Appln. Publn. No. 2013/0104423, which publication is entirely incorporated herein by reference. As some additional examples, if desired, uppers and articles of footwear in accordance with this technology may include foot securing and engaging structures of the types used in footwear products commercially available from NIKE, Inc. of Beaverton, Oregon. These types of wrap-around and/or adaptive or dynamic fit structures may at least partially wrap around and securely hold the wearer's foot.

As yet another alternative or additional feature, if desired, uppers 102 and articles of footwear 100 in accordance with at least some examples of this technology may include fused layers of upper materials, e.g., uppers of the types that include upper materials bonded by hot melt or other adhesive materials, such as in footwear products commercially available from NIKE, Inc. of Beaverton, Oregon. As still additional examples, uppers of the types described in U.S. Pat. Nos. 7,347,011 and/or 8,429,835 may be used without departing from this technology (each of U.S. Pat. Nos. 7,347,011 and 8,429,835 is entirely incorporated herein by reference).

Example sole structures 104 and components thereof now will be described in more detail. As shown in FIGS. 1A to 1D, the sole structure 104 of this example is a cleated sole structure, e.g., well suited for use as part of a soccer/global football shoe. The sole structure 104 may be made from one or more parts, in any desired manner, including in manners conventionally known and used in the footwear arts (such as via injection molding techniques, etc.). The sole structure 104 includes a sole member 106 (made from one or more parts) having a base surface 106S, a medial side 106M, and a lateral side 106L. A plurality of medial side primary traction elements 110M are located on the medial side 106M of the sole member 106 and extend in a direction away from the base surface 106S (e.g., toward and to engage the ground). Similarly, a plurality of lateral side primary traction elements 110L are located on the lateral side 106L of the sole member 106 and extend in a direction away from the base surface 106S (e.g., toward and to engage the ground). The primary traction elements 110M and/or 110L may be located at or proximate to an outer perimeter edge of the sole member 106 and/or the overall sole structure 104. The term "at or proximate to" as used herein in this context and with respect to these components means that at least some portion of the respective primary traction element 110M and/or 110L is located within 15 mm of an outermost perimeter edge of the sole member 106 and/or the overall sole structure 104 when the sole structure 104 is supported on a horizontal support surface in an unloaded condition. Collectively, primary traction elements 110M and 110L that are located "at or proximate to" the outer perimeter edge of the sole structure 104 and/or sole member 106 may be referred to as "outer edge primary traction elements" (and the projection field 200 (described in more detail below) may be at least partially contained within an area defined by the outer edge primary traction elements). In some examples of this invention, the sole structure 104 and/or sole member 106 will include outer edge primary traction elements as the only primary traction elements in the forefoot region and/or in the midfoot region.

The base surface 106S of the sole member 106 may be considered as including the area surrounding and/or around the primary traction elements 110M and 110L (e.g., excluding the primary traction elements 110M and 110L themselves), including, if applicable, the area beneath detachable primary traction elements 110M and 110L that includes hardware for engaging the primary traction elements 110M and 110L to the sole member (e.g., a threaded base area for engaging a threaded attachment mechanism on the bottom of a detachable cleat). The base surface 106S may include secondary traction elements as well (e.g., traction elements having a projecting height of less than 35% of the longitudinal length of the primary traction elements 110L and 110M). Additionally or alternatively, one or more of the primary traction elements 110L, 110M may be integrally formed with the sole member 106, its base surface 106S, and/or other sole structure 104 component, e.g., by molding the primary traction element 110L, 110M with the sole member 106 and/or other sole component.

In this illustrated example, the sole member 106 extends to support an entire plantar surface of a wearer's foot (e.g., it extends continuously from a rear heel location, through the heel region, through the midfoot region, through the forefoot region, and to a forward toe location of the sole structure 104 as well as from the medial side to the lateral side throughout its length). Other options are possible. For example, the sole member 106 may be provided in any one or more of at least a portion of the forefoot region, at least a portion of the midfoot region, and/or at least a portion of the heel region of the sole member 104. For purposes of reference in this specification: (a) the "forefoot region" may be considered the forward ⅓ of the footwear 100/sole structure 104, (b) the "midfoot region" may be considered the central ⅓ of the footwear 100/sole structure 104, and (c) the "heel region" may be considered the rear ⅓ of the footwear 100/sole structure 104 (measured from a rearmost heel location RH to a fowardmost toe location FT—see the broken lines in FIG. 1B).

Figure 1B:
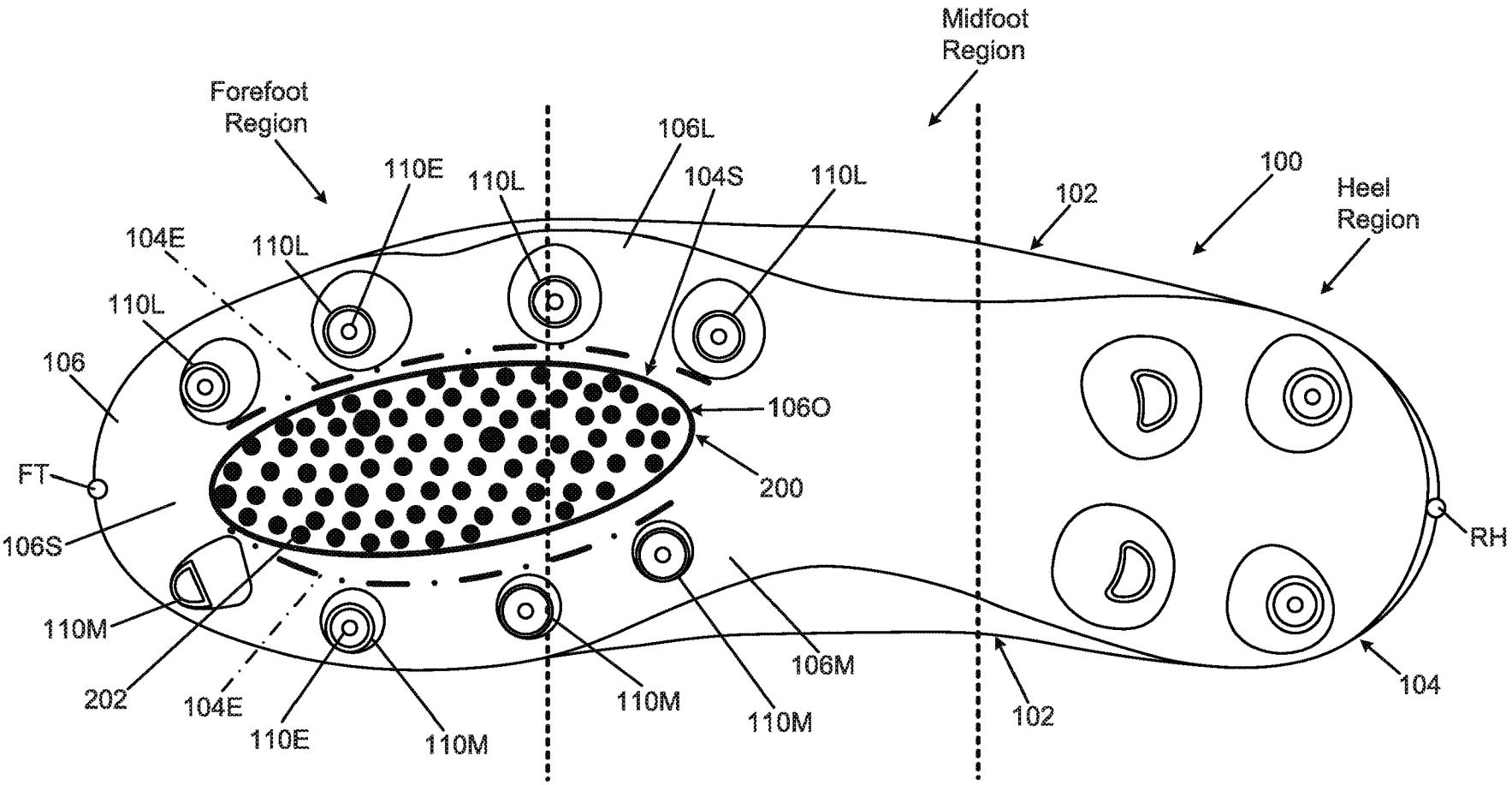

As illustrated in FIG. 1B, a central space 104S is defined between interior extents of the plurality of medial side primary traction elements 110M and the plurality of lateral side primary traction elements 110L. The "interior extents" of the various traction elements may be considered as the interior-most location of the primary traction elements along their lengths (e.g., the locations furthest away from the outer edge of the sole structure 104 and/or sole member 106). Dot-dash lines 104E connecting interior extent locations of the primary traction elements 110M and 110L are shown in FIG. 1B.

In accordance with aspects of this technology, a projection field 200 is located at least partially in the central space 104S. In the illustrated example of FIGS. 1A-1D, the projection field 200 has a majority of its area (e.g., at least 50%, and in some examples at least 60%, at least 70%, at least 80%, at least 90%, or even 100% of its area) located in the forefoot region of the sole member 106 and sole structure 104. In this illustrated example, the projection field 200 extends into the midfoot area of the sole member 106 and sole structure 104. The projection field 200 comprises a plurality of projections 202 that extend beyond the base surface 104S and have exposed free ends 202E. The projection field 200 and the individual projections 202 thereof may have various different properties and combinations of properties, as will be described in more detail below.

As some more specific examples, the plurality of projections 202 in the projection field 200 may include at least 20 projections, and in some examples, at least 30, at least 35, at least 40, at least 45, at least 50, from 20 to 250, from 35 to 225, from 50 to 200, from 20 to 100, from 25 to 90, from 30 to 90, or other number (N) of projections. The projection field 200 may define any desired area of any desired shape, including an area of at least 900 $mm^2$ with projections 202 dispersed throughout (and in some example, areas within the ranges of one or more of: at least 1200 $mm^2$, at least 1600 $mm^2$, at least 2400 $mm^2$, from 900 $mm^2$ to 5000 $mm^2$, from 1200 $mm^2$ to 4000 $mm^2$, from 1600 $mm^2$ to 3600 $mm^2$, etc.).

The projection field 200 area may be defined at least by the area located within lines connecting the outermost extents of the plurality of projections 202 in the projection field 200.

The projections 202 may be dispersed evenly or unevenly throughout the projection field 200 area. At least a portion of the projection field 200 area (and in some examples, a majority, at least 75%, at least 80%, at least 85%, at least 90%, at least 95%, or even all of the projection field 200 area) will include a projection 202 packing density of at least 4 projections 202 per square inch (at least 0.62 projections per square centimeter) (and in some examples at least 2 projections 202 per square inch (at least 0.31 projections per square centimeter), at least 3 projections 202 per square inch (at least 0.47 projections per square centimeter), at least 6 projections 202 per square inch (at least 0.93 projections per square centimeter), at least 8 projections 202 per square inch (at least 1.24 projections per square centimeter), 2 to 24 projections 202 per square inch (0.31 to 3.72 projections per square centimeter), 4 to 20 projections 202 per square inch (0.62 to 3.1 projections per square centimeter), and/or 8 to 16 projections 202 per square inch (1.24 to 2.48 projections per square centimeter). Any desired proportion of the total number N of projections 202 described in the specific ranges above may have any of the specific packing density ranges described above.

In some examples of this technology, a first subset of the plurality of projections 202 (and in some examples, a majority, at least 75%, at least 80%, at least 85%, at least 90%, at least 95%, or even all of the projections 202 in the projection field 200 area) may have a length L of at least 8 mm (and in some examples, a length L of at least 4 mm, at least 6 mm, at least 10 mm, at least 12 mm, less than 36 mm, less than 30 mm, within a range of 4 mm to 36 mm, within a range of 6 mm to 30 mm, within a range of 8 mm to 28 mm, and/or within a range of 10 mm to 26 mm). Additionally or alternatively, at least a majority of the plurality of projections 202 in the projection field 200 (and in some examples, at least 75%, at least 80%, at least 85%, at least 90%, at least 95%, or even all of the projections 202 in the projection field 200 area) will readily bend under force applied by weight of a user of the sole structure 104 and/or sole member 106 (e.g., when the wearer contacts the ground).

Additionally or alternatively, in at least some examples of this technology, with the sole structure 104 and/or sole member 106 supported on its ground-facing surface on a horizontal support surface S (e.g., as shown in FIG. 1A), a first subset of the plurality of projections 202 in the projection field 200 will have their free ends 202E extending toward the horizontal support surface S beyond the free end 104E of a closest primary traction element 110L, 110M to the respective projection 202. See gap G shown in FIGS. 2 and 3 (this measurement/determination may be made with the projection 202 extended to its full length (and not bent)). The first subset of the plurality of projections 202 having the free end length properties described above may constitute at least 25%, at least 30%, at least 40%, a majority, at least 60%, at least 65%, at least 70%, at least 75%, at least 80%, at least 85%, at least 90%, at least 95%, at least 98%, or even all of the projections 202 in the projection field 200 area.

The projection field 200 may be incorporated into a footwear 100 structure and/or sole structure 104 in any desired manner without departing from this technology. As one example, if desired, one or more of the projections 202 (and optionally all of the projections 202) could be individually engaged with the sole structure 104 (e.g., with sole base member 106) by adhesives or cements, mechanical fasteners, etc. Additionally or alternatively, one or more of the projections 202 (and optionally all of the projections 202) could be integrally formed as part of the sole structure 104 (e.g., part of the sole base member 106) when the sole structure is created (e.g., in a molding step).

Figure 2:
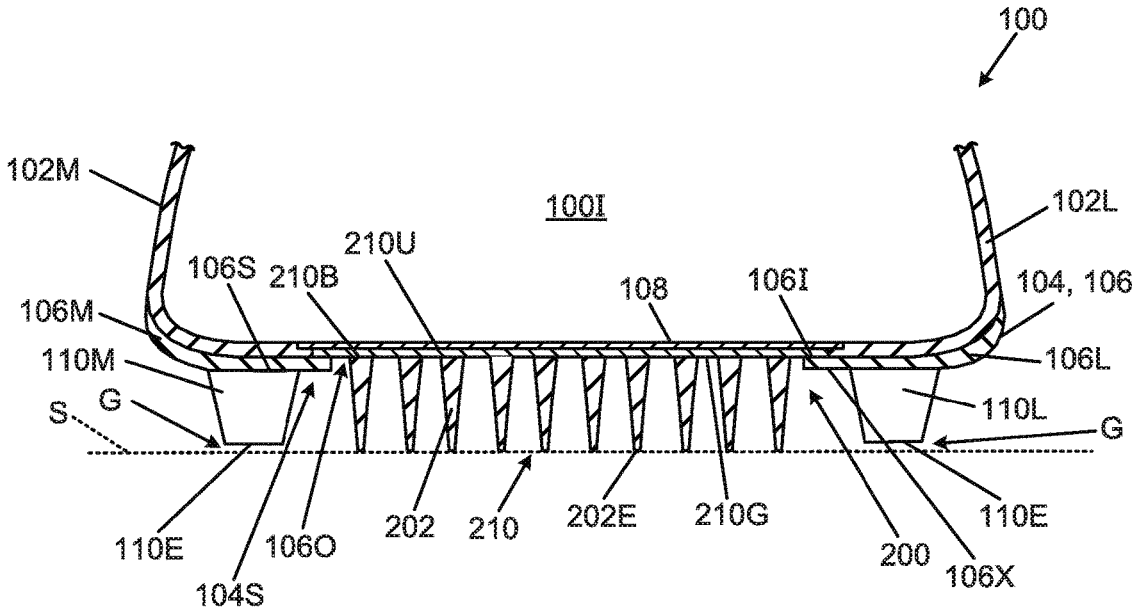
FIGS. 2 and 3 provide partial vertical cross sectional views through footwear having a projection field, e.g., at section line 2,3-2,3 of FIG. 1A, showing different ways of mounting a projection field in an article of footwear and sole structure in accordance with examples of this technology.
Figure 3:
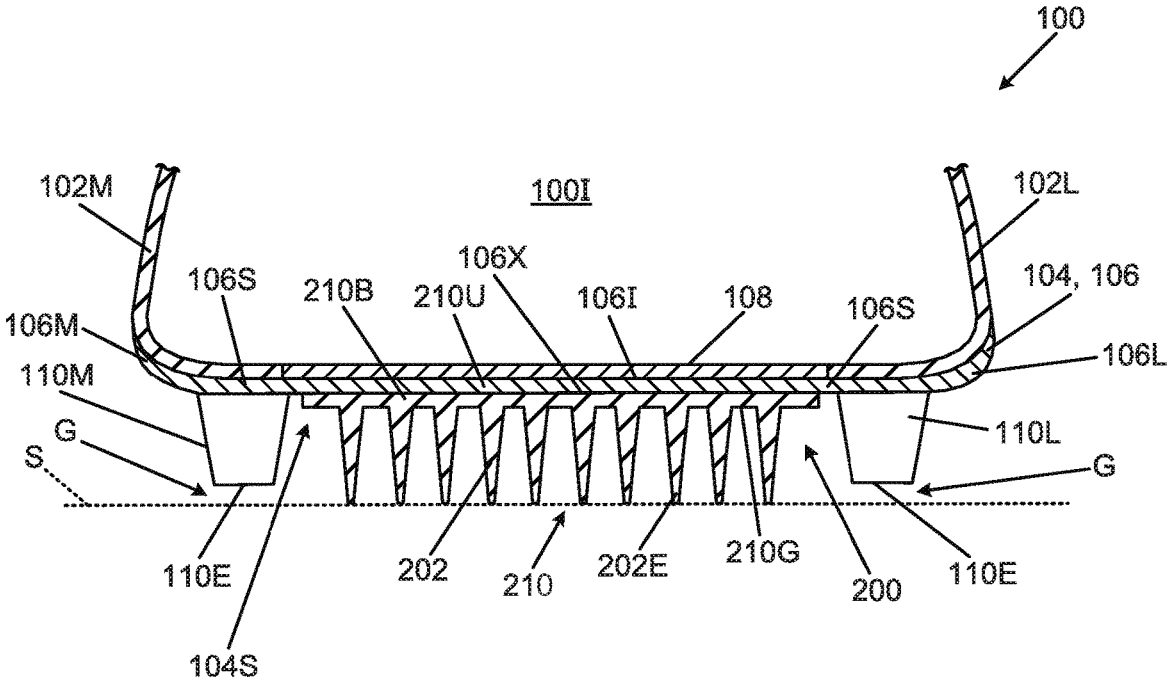

As an alternative or additional possibility, the projection field 200 may be incorporated into a sole structure 104 as one or more separate components 210 that include one or more projections 202. FIGS. 2 and 3 show examples of such structures. As shown in these figures, the component 210 forming these projection fields 200 includes a projection field base 210B having a first surface 210U (e.g., an upper-facing surface) and a second surface 210G (e.g., a ground-facing surface) opposite the first surface 210U. A plurality of projections 202 originate at the second surface 210G and extend from the projection field base 210B in a direction away from the first surface 210U and the second surface 210G.

Figure 1D:
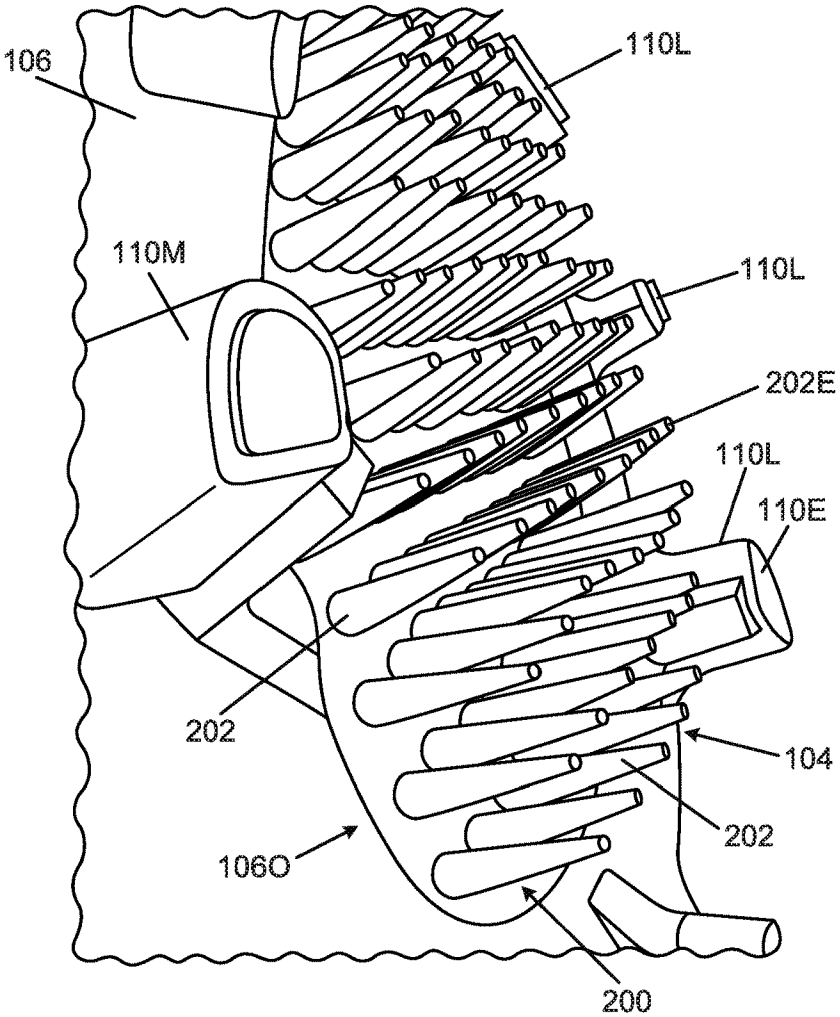
Figure 1C:
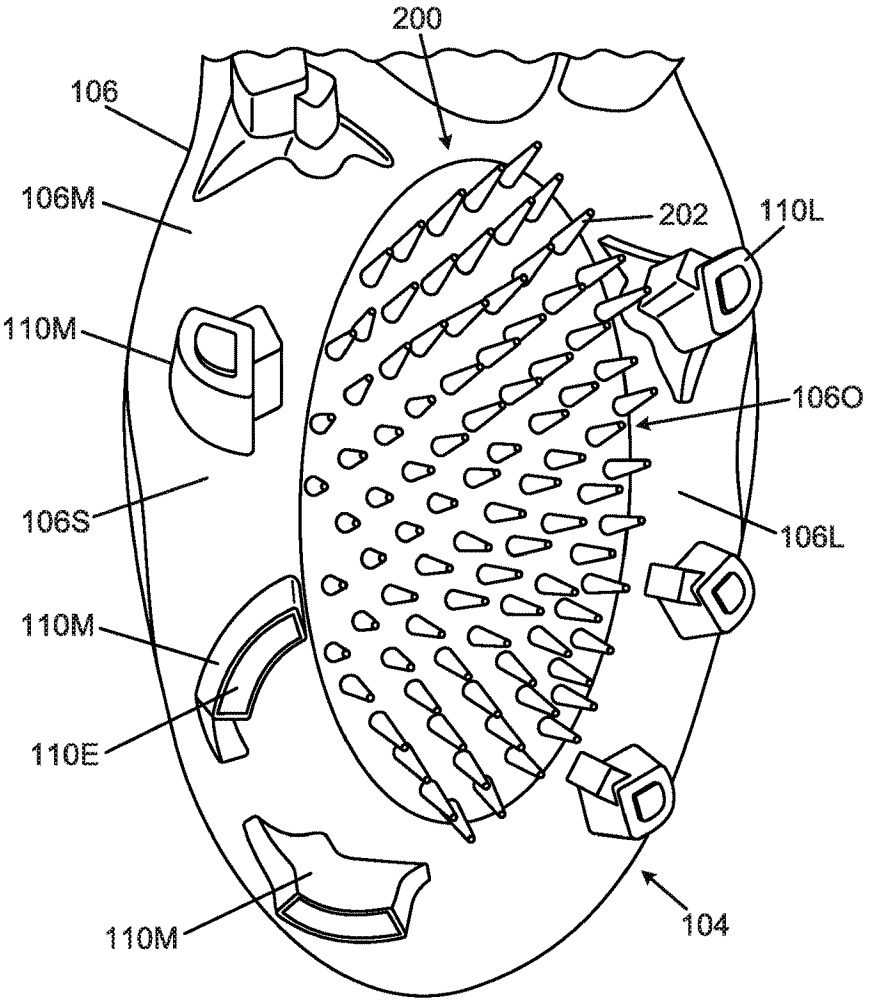

In the example structure of FIG. 2, the base surface 106S of the sole member 106 includes an interior surface 106I and an exterior surface 106X opposite the interior surface 106I. An opening 106O extends completely through the base surface 106S from the interior surface 106I to the exterior surface 106X. The edge of the opening 106O also is shown in FIGS. 1B-1D. In such structures, the second surface 210G (the ground-facing surface) of the projection field base 210B is engaged with the interior surface 106I of the base surface 106S, e.g., at least around a portion of the outer perimeter edge(s) of the projection field base 210B. The projection field base 210B (e.g., at least at the perimeter of its ground-facing surface 210G) may be engaged with the base surface 106S of the sole member 106 (e.g., its interior surface 106I) by one or more of adhesives or cements, mechanical connectors, fusing technology, etc. The plurality of projections 202 of the projection field 200 extend outward and through the opening 106O.

The structure of FIG. 2 (e.g., with at least a portion of a projection field component 210 mounted on and to the interior surface 106I of a sole member 106) is advantageous in at least some examples of this technology because a substantial portion of the relatively stiff sole member 106 is removed at opening 106O. As shown in FIG. 2, in this type of structure, the first surface 210U of the projection field 200 component 210 may be directly engaged with a bottom of the upper 102, e.g., with a strobel component 108 or other bottom surface of the upper 102. In such structures, the first surface 210U of the projection field base 210B may be flexible (e.g., to conform to the shape of a wearer's foot), planar, and/or smoothly contoured (e.g., suitable for engaging a wearer's foot through the bottom 108 of the upper 102). In footwear 100 structures in which the projection field component 210 is sufficiently flexible, this arrangement can help transmit forces incident on the projection field component 210 and the projections 202 (e.g., from the foot engaging a soccer ball) to the wearer's foot located in the interior chamber 100I of the footwear structure 100. This force transmission helps the wearer "feel" the ball beneath his/her foot, assists the wearer in knowing where the ball is located and what is it doing (with less need to view the ball visually), and helps the wearer better control the ball (with less need to view the ball visually).

When present, the opening 106O through which the projection field component 210 is exposed may have a size (area) of at least 900 $mm^2$ (and in some example, an area within the ranges of one or more of: at least 1200 $mm^2$, at least 1600 $mm^2$, at least 2500 $mm^2$, from 900 $mm^2$ to 5000 $mm^2$, from 1200 $mm^2$ to 4000 $mm^2$, from 1600 $mm^2$ to 3600 $mm^2$, etc.).

FIG. 3 illustrates an additional or alternative arrangement of a projection field component 210 on a sole structure 104 and/or sole member 106 in accordance with at least some aspects of this technology. In this example structure, the first surface 210U (the upper-facing surface) of the projection field base 210B is engaged with the exterior surface 106X of the base surface 106S of the sole member 106. While the illustrated example of FIG. 3 does not include an opening 106O as shown in the example of FIG. 2, such an opening could be provided, e.g., beneath at least some portion of the overall area where the projection field component 210 is engaged with the sole member 106. The projection field component 210 may be engaged with exterior surface 106X of the base surface 106S and/or other part of the sole member 106/sole structure 104 in any desired manner, including by one or more of adhesives or cements, mechanical connectors, fusing technology, etc. Because of the sole member 106 base surface 106S located between the projection field component 210 and the interior chamber 100I of the footwear structure 100 in this example (over at least some portion of their interface), this structure may provide somewhat less of the "feel" characteristics described above for the example of FIG. 2 (with the opening 106O). But, if desired, the base surface 106S may be made thin and/or flexible at least in the area above the projection field component 210 (e.g., less than 4 mm thick, or even less than 2 mm thick) to permit some level of force transmission (e.g., from ball contact) through the base surface 106S.

Figure 4:
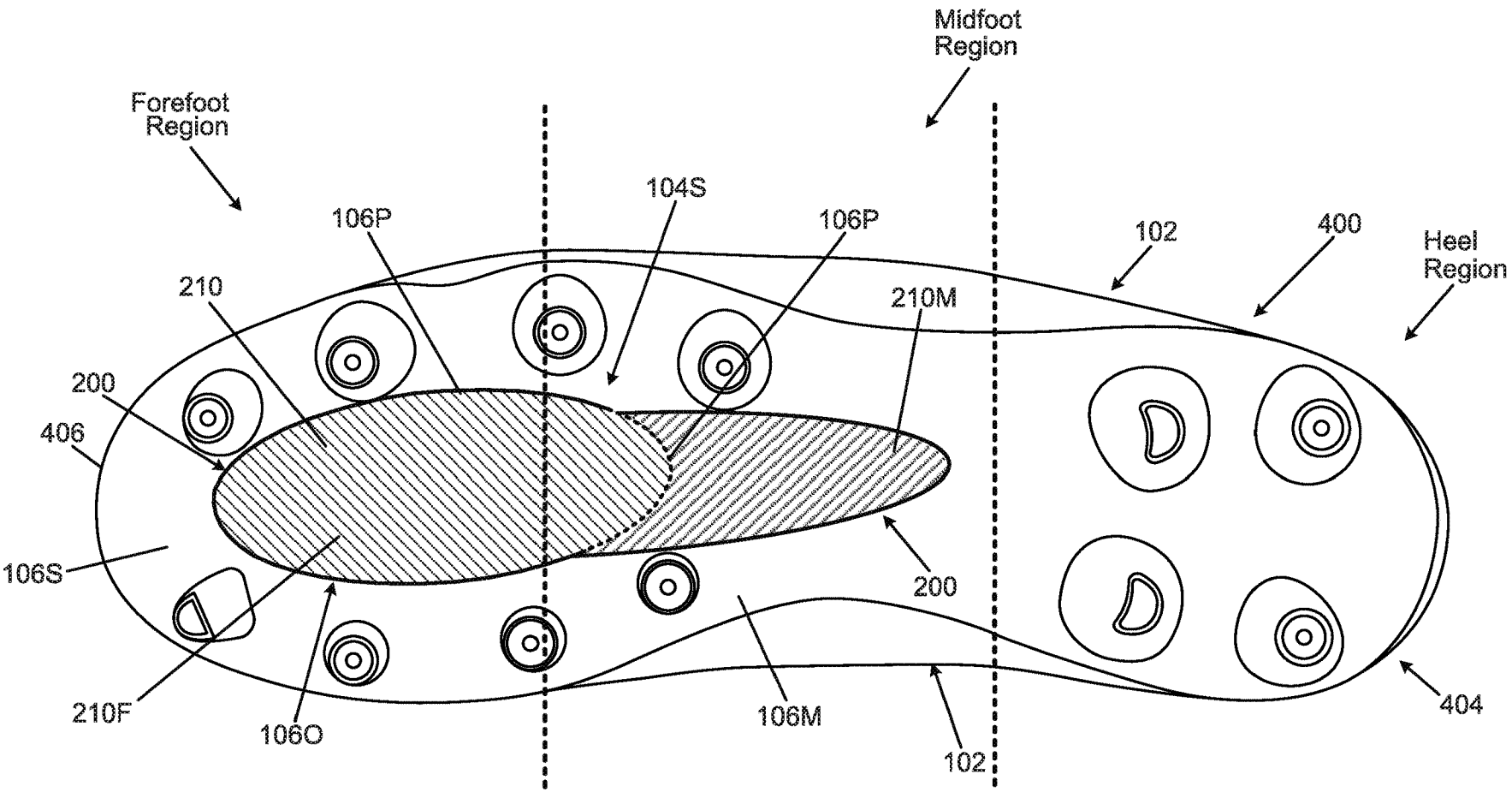
FIG. 4 provides a bottom view of another example article of footwear and sole structure in accordance with aspects of this technology.

In the structures illustrated in FIGS. 1A-1D, the projection field 200 is located primarily in the forefoot region of the sole structure 104 and/or the sole member 106. Other arrangements are possible. For example, FIG. 4 shows an article of footwear 400 having a sole structure 404 in which the projection field 200 extends continuously from the forefoot region at least into and through much of the midfoot region of the sole structure 404 and/or sole member 406. Any other desired arrangement or proportion of the sole member 406 may include a projection field 200 without departing from this technology, including one or more of the forefoot region, the midfoot region, and/or the heel region. Also, if desired, a single sole structure 404 and/or sole member 406 may include two or more discrete projection fields 200 located in any individual region and/or combination of regions in the footwear 400, sole structure 404, and/or sole member 406 construction. Wherever located, the sole member 406 and the projection field 200 may have either of the structures and/or engagement arrangements shown in FIGS. 2 and/or 3.

The example projection field 200 of the sole structure 404 and sole member 406 shown in FIG. 4 includes: (a) a first portion 210F located primarily in a forefoot region of the sole structure 404 and sole member 406 (and extending into the midfoot region), and (b) a second portion 210M located primarily or fully in a midfoot region of the sole structure 404 and sole member 406. Thus, in this illustrated example, the projection field 200 extends continuously from the forefoot region to the midfoot region of the sole structure.

In the example structure of FIG. 4, the projection field 200 and the sole member 406 may be engaged together by either of the individual structures and/or engagement arrangements shown in FIG. 2 or FIG. 3. As another example, however, the sole structure 404 of FIG. 4 (as well as other sole structures in accordance with aspects of this technology) may include features of both FIG. 2 and FIG. 3 in a single sole structure 404/sole member 406. More specifically, in this illustrated example, the base surface 106S of the sole member 406 includes an interior surface 106I and an exterior surface 106X opposite the interior surface 106I, as described above in conjunction with FIGS. 2 and 3. An opening 106O, as described above in conjunction with FIG. 2, is provided through the base surface 106S over a portion of the sole member 406 (e.g., the opening 106O may be provided beneath the first portion 210F of the projection field 200 in the example of FIG. 4). At this first portion (e.g., 210F) of the projection field 200, the second surface 210G of the projection field base 210B is engaged with the interior surface 106I of the base surface 106S (e.g., around the perimeter of the projection field base 210B and the perimeter of the opening 106O) and the plurality of projections 202 extend through the opening 106O as described in conjunction with FIG. 2. The outer perimeter of the opening 106O is shown as element 106P in FIG. 4. Additionally, in this example structure, the projection field base 210 extends outside the sole member 406 at a second portion of the projection field (e.g., portion 210M). In this second portion 210M, the first surface 210U of the projection field base 210B is engaged with the exterior surface 106X of the base surface 106S of the sole member 406, as described in conjunction with FIG. 3. The different hatching in FIG. 4 illustrates: (a) the region with the opening 106O underlying the projection field component 210 (in region 210F in this example) and (b) the region without an underlying opening 106O (in region 210M in this example). Thus, in this example sole structure 404 of FIG. 4: additional arch support is provided by including the sole member 406 base surface 106S in the midfoot region, improved feel is provided at the forefoot region (because of the opening 106O), and a larger projection field 200 area is provided for engaging the ball. Although present in this example sole structure 404, the projections 202 are not shown in the depiction of FIG. 4 to prevent obscuring other details as described above.

Projection 202 length L also may vary over the area of a projection field 200. As some more specific examples, projection length L may vary over a medial side-to-lateral side direction of a sole structure 104. As one example, the projection length L may get longer or extend further downward in directions toward the center of the projection field (in the medial side-to-lateral side direction) so that the longest and/or furthest extending projections 202 are located in a central area of the projection field 200 and/or sole structure 104. As another example, the projection length L may get shorter or extend less downward in directions toward the center of the projection field (in the medial side-to-lateral side direction) so that the longest and/or furthest extending projections 202 are located at the outer edges of the projection field 200 and/or sole structure 104. Additionally or alternatively, as another example, in the structure shown in FIG. 4, the projection lengths L may get shorter or extend downward a shorter distance (e.g., progressively shorter) moving toward the rear of the sole structure 104 (e.g., so that the projections 202 in the forefoot region 210F are somewhat longer or project further downward than the projections 202 in the midfoot region 210M). Other variations in projection length L over the course of a projection field 200 and/or sole structure 104 are possible without departing from this technology.

As noted above, the individual projections 202 may be formed of a material and structured so that they will readily bend, e.g., under force applied thereto by a wearer's foot and contact with a ground surface and/or under force applied thereto by contact with a ball. The individual projections also may be made from a resilient material, e.g., so that they tend to spring back toward or to their original shape after the force(s) is/are sufficiently relaxed. Examples of such materials for the individual projections 202 (as well as the entire projection field 200) include thermoplastic polyurethane materials or other plastic materials. As the projections 202 interact with a ball, force from ball contact with the projections 202 may be transmitted to a wearer's foot (e.g., through the opening 106O in the sole member 106, 406 and/or, in some examples, even through the base surface 106S of the sole member 106, 406). This force transmission, as noted above, may help the wearer "feel" the ball beneath his/her feet, may assist the wearer in knowing where the ball is located and what is it doing (with a lesser need for the player to look down at the ball), and may help the wearer better control the ball (e.g., by better knowing the ball position and what the ball is doing). The hardness of the projection material may impact the amount of force transmitted to the wearer's foot (e.g., with harder projections 202 bending less readily and thus potentially transmitting more force to the wearer's foot).

Additionally (or alternatively), interaction of the ball with the projections 202 in the projection field 200 may produce an audible scraping or rustling sound as the projections 202 move with respect to the ball surface. This audible response also can provide user feedback, e.g., to help the wearer better understand ball position and what the ball is doing underfoot, to control ball possession, etc. Various features of the projections 202 and projection field 200 may enable control over the audible response, such as the number/packing density of the projections 202, the hardness/stiffness of the projections, etc.

Figure 5C:
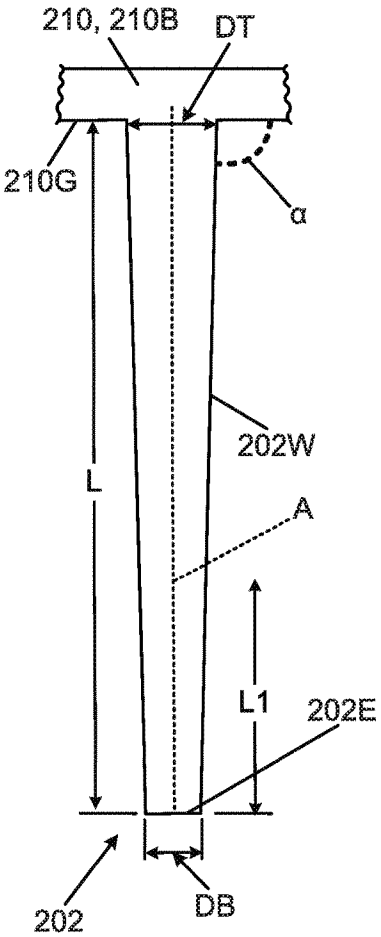
FIGS. 5A-8C provide various views of projections and portions of projection fields in accordance with some aspects of this technology.
Figure 5A:
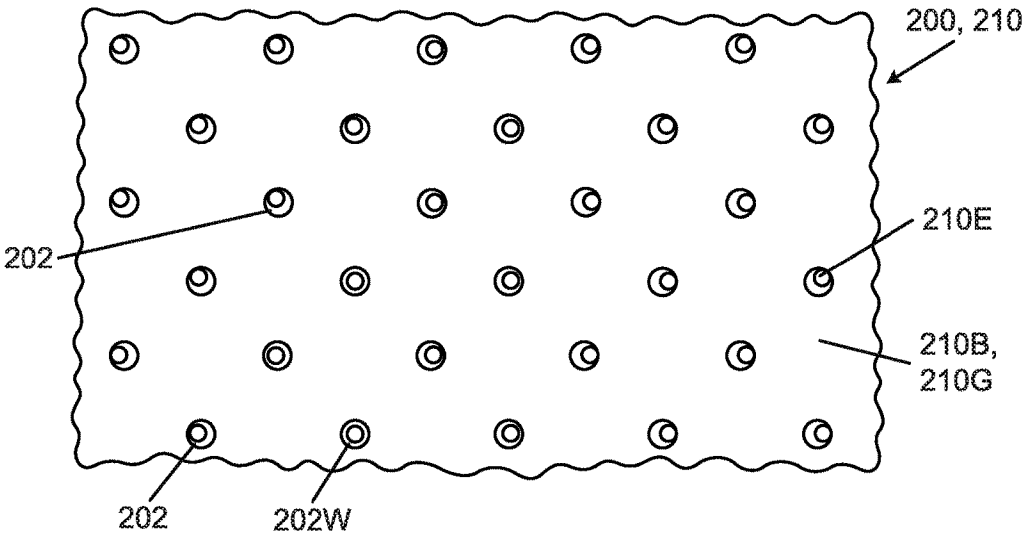

FIGS. 5A through 8C illustrate various views of example projections 202 and portions of projection fields 200 that may be used in accordance with at least some examples of this technology. FIGS. 5A and 5B provide a partial bottom view and a partial side view, respectively, of an example projection field 200, and FIG. 5C provides an enlarged view of an individual projection 202. As shown in these figures, the projection field 200 may include rows of projections 202 having a longitudinal length L and a transverse cross-sectional diameter or dimension. FIG. 5C shows that an individual projection 202 may originate at or extend from the projection field base 210B and extend to a free end 202E. The longitudinal length L extends between the projection origination point (e.g., at projection field base 210B) and the free end 202E. To measure this longitudinal length L, it may be necessary to extend the projection 202 to its full length (e.g., if the projection 202 has a curved or bent shape).

As shown in FIG. 5C, in this illustrated example, at least some of the individual projections 202 (and optionally a majority, at least 60%, at least 70%, at least 80%, at least 90%, at least 95%, or even all of the individual projections 202) of the projection field 200 may have: (a) a top diameter DT (where the projection 202 extends from the projection field base 210B), (b) a bottom diameter DB (at the free end 202E), and (c) a longitudinal length L extending from the top to the free end 202E. One or more of the projections 202 in the projection field 200 may include an angle α formed from the second surface 210G (ground-facing surface) of the projection field base 210B to the sidewall 202W of the projection 202 over at least a portion of the longitudinal length L, e.g., in a range of 90 degrees to 140 degrees. Thus, the projection 202 may taper to its smallest diameter and/or transverse area at the free end 202E. These angular and taper features may be present, for example, over a majority, at least 60%, at least 70%, at least 80%, at least 90%, at least 95%, or even all of the longitudinal length L of an individual projection 202 (e.g., measured upward from the free end 202E). Additionally or alternatively, the projection sidewall 202W may extend at an angle of from 0 degrees to 30 degrees with respect to the central axial direction A of the projection 202 over at least a portion of the longitudinal length L. Similarly, this angular feature may be present, for example, over a majority, at least 60%, at least 70%, at least 80%, at least 90%, at least 95%, or even all of the longitudinal length L of an individual projection 202 (e.g., measured upward from the free end 202E).

Figure 5B:
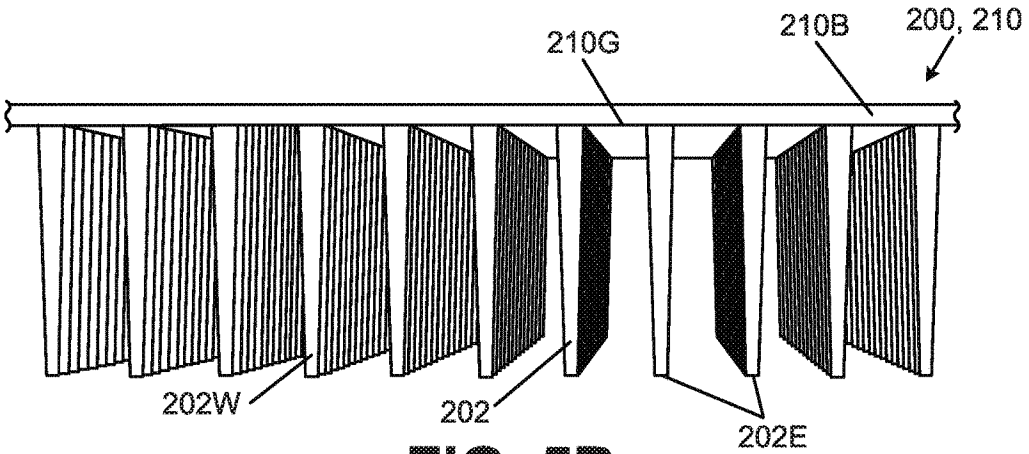

For the specific example shown in FIGS. 5A-5C, the projection field 200 and/or at least some of the individual projections 202 (and optionally a majority, at least 60%, at least 70%, at least 80%, at least 90%, at least 95%, or even all of the individual projections 202 of the projection field 200) may have one or more of the following properties: (a) a circular transverse cross section (transverse to the longitudinal length L with the projection L oriented straight); (b) DT=2 mm (or within the range of between 1 mm and 6 mm); (c) DB=1 mm or less (or within the range of 0 mm (i.e., a point) to 3 mm; (d) DT/DB=2 (or within a range of 1 to infinity); (e) length L=24 mm (or within the range of 4 mm to 36 mm); (f) minimum axial length having transverse cross sectional diameter less than 6 mm=at least 4 mm (or within a range of 4 mm to 36 mm, e.g., measured upward from the free end 202E); and/or (g) L/DT=12 (or within a range of 1.5 to 36).

Figure 6A:
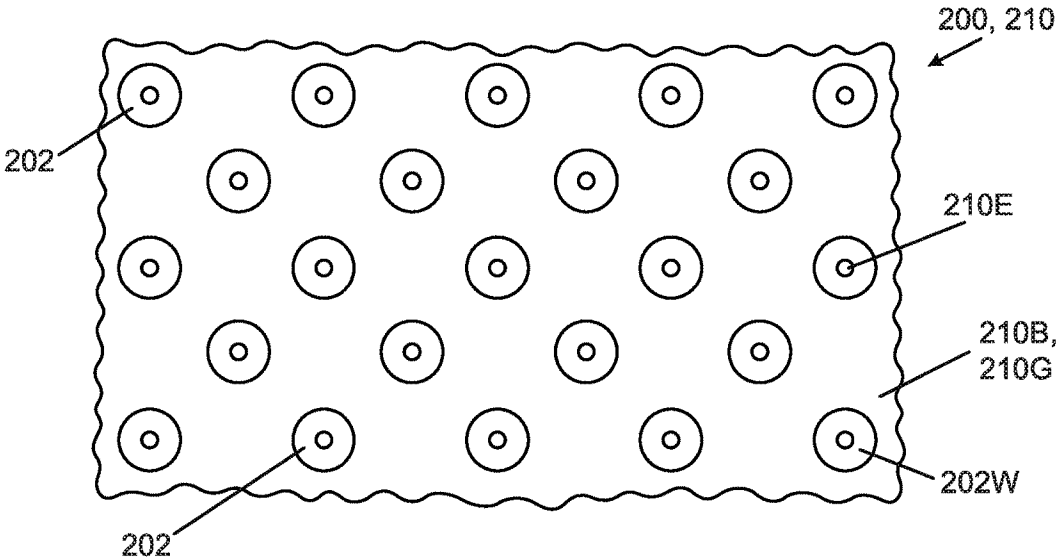
Figure 6B:
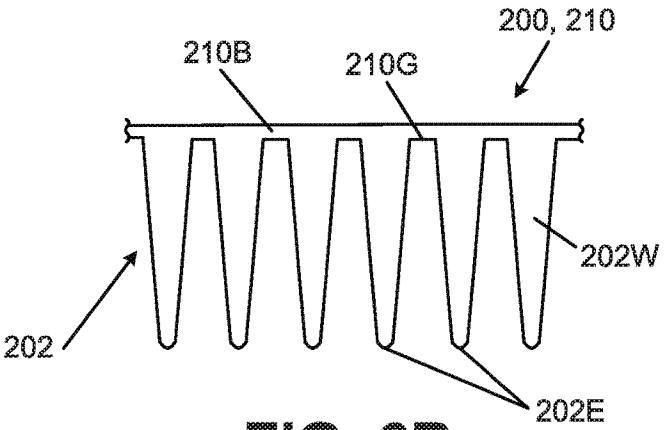
Figure 6C:
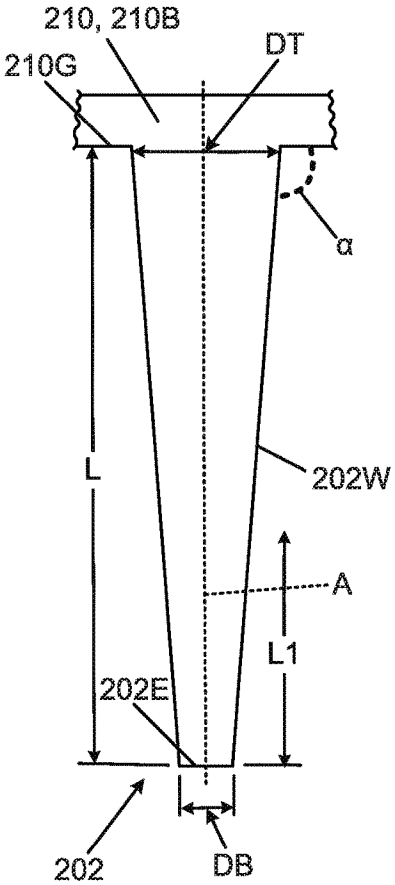

FIGS. 6A and 6B provide a partial bottom view and a partial side view, respectively, of an example projection field 200, and FIG. 6C provides an enlarged view of an individual projection 202. The example of FIGS. 6A-6C has a wider base (DT) and a greater taper angle α as compared to the example of FIGS. 5A-5C. As shown in these figures, the projection field 200 may include rows of projections 202 having a longitudinal length L and a transverse cross-sectional diameter or dimension. FIG. 6C shows that an individual projection 202 may originate at or extend from the projection field base 210B and extend to a free end 202E. The longitudinal length L extends between the projection origination point (e.g., at projection field base 210B) and the free end 202E. To measure this longitudinal length L, it may be necessary to extend the projection 202 to its full length (e.g., if the projection 202 has a curved or bent shape).

As shown in FIG. 6C, in this illustrated example, at least some of the individual projections 202 (and optionally a majority, at least 60%, at least 70%, at least 80%, at least 90%, at least 95%, or even all of the individual projections 202) of the projection field 200 may have: (a) a top diameter DT (where the projection 202 extends from the projection field base 210B), (b) a bottom diameter DB (at the free end 202E), and (c) a longitudinal length L extending from the top to the free end 202E. One or more of the projections 202 in the projection field 200 may include an angle α formed from the second surface 210G (ground-facing surface) of the projection field base 210B to the sidewall 202W of the projection 202 over at least a portion of the longitudinal length L, e.g., in a range of 90 degrees to 140 degrees. Thus, the projection 202 may taper to its smallest diameter and/or transverse area at free end 202E. These angular and taper features may be present, for example, over a majority, at least 60%, at least 70%, at least 80%, at least 90%, at least 95%, or even all of the longitudinal length L of an individual projection 202 (e.g., measured upward from the free end 202E). Additionally or alternatively, the projection sidewall 202W may extend at an angle of from 0 degrees to 30 degrees with respect to the central axial direction A of the projection 202 over at least a portion of the longitudinal length L. Similarly, this angular feature may be present, for example, over a majority, at least 60%, at least 70%, at least 80%, at least 90%, at least 95%, or even all of the longitudinal length L of an individual projection 202 (e.g., measured upward from the free end 202E).

For the specific example shown in FIGS. 6A-6C, the projection field 200 and/or at least some of the individual projections 202 (and optionally a majority, at least 60%, at least 70%, at least 80%, at least 90%, at least 95%, or even all of the individual projections 202 of the projection field 200) may have one or more of the following properties: (a) a circular transverse cross section (transverse to the longitudinal length L with the projection L oriented straight); (b) DT=5 mm (or within the range of between 1 mm and 10 mm); (c) DB=0.5 mm or less (or within the range of 0 mm (i.e., a point) to 3 mm; (d) DT/DB=10 (or within a range of 1 to infinity); (e) length L=24 mm (or within the range of 4 mm to 36 mm); (f) minimum axial length having transverse cross sectional diameter less than 6 mm=at least 4 mm (or within a range of 4 mm to 36 mm, e.g., measured upward from the free end 202E); and/or (g) L/DT=4.8 (or within a range of 1.5 to 36).

The examples of FIGS. 5A to 6C show projections 202 having circular transverse cross sections. For projections 202 having a rounded shape but non-circular transverse cross sections (e.g., elliptical, oval, oblong, etc.), the term "diameter" in the discussion and equations above (and the discussion below) may be interpreted as the widest or largest transverse cross sectional dimension of the projection 202. The same values and/or ranges of values described above for the examples of FIGS. 5A to 6C apply to the widest or largest transverse cross sectional dimension of such other rounded but non-circular shape projections 202. As some more specific examples, at least 20 projections 202 in projection fields 200 of the types shown in FIGS. 5A-6C may have one or more of the following properties: a largest transverse cross sectional diameter/dimension of 10 mm or less; a largest transverse cross sectional diameter/dimension of 5 mm or less; a largest transverse cross sectional diameter/dimension of 3 mm or less; and/or a tapered shape along the length dimension L to a smallest transverse cross sectional diameter/dimension at the free ends 202E of the respective projection 202. Any of the above properties also may apply to at least 25 projections 202, at least 30 projections 202, at least 35 projections 202, at least 40 projections 202, or even at least 50 projections 202 in a projection field 200.

In accordance with at least some examples of this technology, when including projections 202 having circular or other rounded transverse cross sections in a projection field 200, at least some of the individual projections 202 (and optionally at least 25%, at least 40%, at least 50%, at least 60%, at least 70%, at least 80%, at least 90%, at least 95%, or even all of the individual projections 202) of the projection field 200 may have one or more and/or any combination of the properties and/or property values set forth in Table 1 below:

TABLE 1

| Parameter | Value A | Value B | Value C |
|---|---|---|---|
| Top Diameter/Dimension (DT) | Less than 12 mm | Less than 10 mm | Less than 8 mm |
| Bottom Diameter/Dimension (DB) | Less than 6 mm | Less than 4 mm | Less than 2 mm |
| Length Dimension (L) | At least 4 mm | At least 6 mm | At least 8 mm |
| Length Dimension (L) | At least 10 mm | At least 15 mm | At least 20 mm |
| Top Diameter/Dimension (DT) | 1 mm to 12 mm | 2 mm to 10 mm | 3 mm to 8 mm |
| Bottom Diameter/Dimension (DB) | 0 mm to 6 mm | 0.25 mm to 4 mm | 0.5 mm to 2 mm |
| Length Dimension (L) | 4 mm to 36 mm | 8 mm to 30 mm | 10 mm to 26 mm |
| Length Having Transverse Cross Sectional Diameter/Dimension Less Than 12 mm* | At least 4 mm | 4 mm to 36 mm | 6 mm to 30 mm |
| Length Having Transverse Cross Sectional Diameter/Dimension Less Than 10 mm* | At least 4 mm | 6 mm to 36 mm | 10 mm to 30 mm |
| Length Having Transverse Cross Sectional Diameter/Dimension Less Than 8 mm* | At least 4 mm | 6 mm to 36 mm | 10 mm to 30 mm |
| Length Having Transverse Cross Sectional Area Less Than 150 $mm^2$* | At least 4 mm | 4 mm to 36 mm | 6 mm to 30 mm |
| Length Having Transverse Cross Sectional Area Less Than 120 $mm^2$* | At least 4 mm | 6 mm to 36 mm | 10 mm to 30 mm |
| Length Having Transverse Cross Sectional Area Less Than 100 $mm^2$* | At least 4 mm | 6 mm to 36 mm | 10 mm to 30 mm |
| DT/DB | 1 to Infinity | 1.5 to 30 | 2 to 20 |
| L/DT | 1.5 to 36 | 2 to 30 | 3 to 25 |

TABLE 1-continued

| Parameter | Value A | Value B | Value C |
|---|---|---|---|
| Base to Sidewall Angle (or Taper Angle)** | 90 degrees to 140 degrees | 95 degrees to 130 degrees | 98 degrees to 120 degrees |
| Axial Direction to Sidewall Angle** | 0 degrees to 30 degrees | 2 degrees to 20 degrees | 4 degrees to 15 degrees |

*The "Length" having the various transverse cross sectional diameter, dimension, and/or area features may be less than the full longitudinal length L of the projection 202 (i.e., a portion of the length L of the projection 202), and this length or length portion may be measured from an origin point located at the free end 202E of the projection 202. Note dimension L1 in FIGS. 5C and 6C.
**The angular values need not be included over the entire longitudinal length L of the projection 202, but may be present, for example, over at least 50% of the projection's longitudinal length, optionally at the bottom half of the projection's longitudinal length L.

Figure 7A:
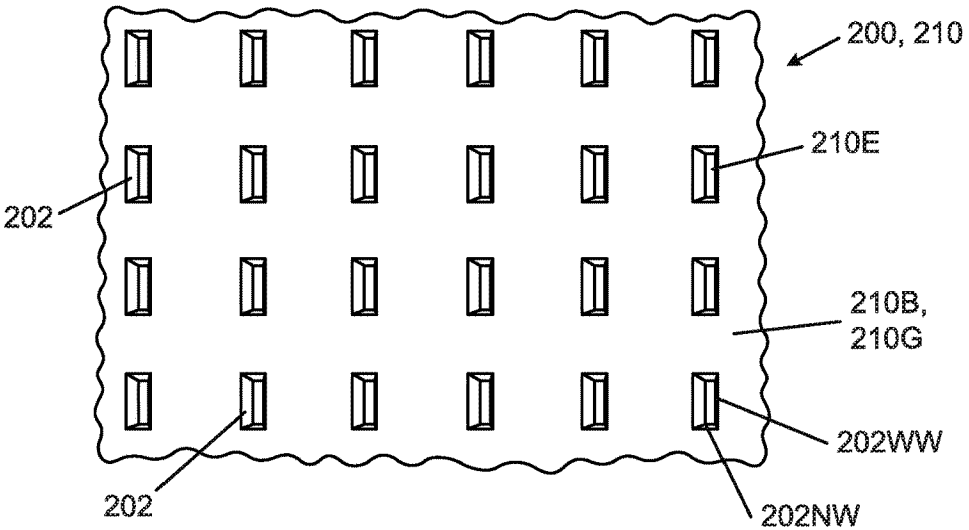
Figure 7C:
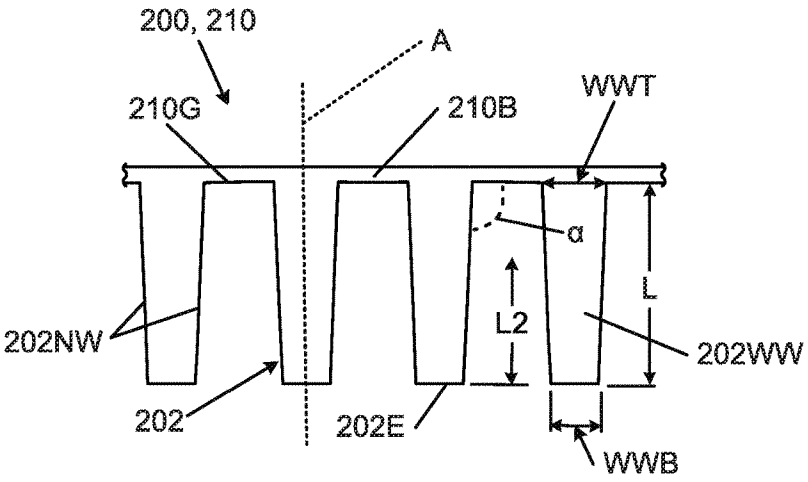
Figure 7B:
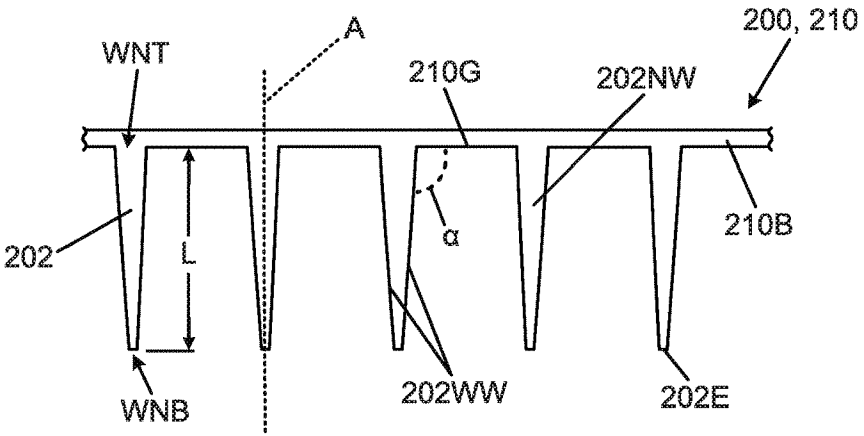

Projections 202 may have transverse cross sectional shapes other than rounded or circular. FIGS. 7A through 8C show projections 202 having polygonal shapes (e.g., four sided parallelograms, optionally generally rectangular, square, etc.). FIG. 7A provides a partial bottom view of an example projection field 200, FIG. 7B provides a narrow side (polygon narrow side) view of the projection field 200, and FIG. 7C provides a wide side (polygon wide side) view of the projection field 200. As shown in these figures, the projection field 200 may include rows of projections 202 having a longitudinal length L and a generally rectangular transverse cross-sectional shape. FIGS. 7B and 7C show that an individual projection 202 may originate at or extend from the projection field base 210B and extend to a free end 202E. The longitudinal length L extends between the projection origination point (e.g., at projection field base 210B) and the free end 202E. To measure this longitudinal length L, it may be necessary to extend the projection 202 to its full length (e.g., if the projection 202 has a curved or bent shape).

As shown in FIG. 7B, in this illustrated example, at least some of the individual projections 202 (and optionally a majority, at least 60%, at least 70%, at least 80%, at least 90%, at least 95%, or even all of the individual projections 202) of the projection field 200 may have: (a) a narrow side width dimension at the top WNT (where the projection 202 extends from the projection field base 210B), (b) a narrow side bottom dimension WNB (at the free end 202E), and (c) a longitudinal length L extending from the top to the free end 202E. As shown in FIG. 7C, one or more of the projections 202 in the projection field 200 may include an angle $\alpha$ formed from the second surface 210G (ground-facing surface) of the projection field base 210B to the narrow sidewall 202NW of the projection 202 over at least a portion of the longitudinal length L, e.g., in a range of 90 degrees to 140 degrees. Thus, the projection 202 may taper to its smallest transverse area at free end 202E. These angular and taper features may be present, for example, over a majority, at least 60%, at least 70%, at least 80%, at least 90%, at least 95%, or even all of the longitudinal length L of an individual projection 202 (e.g., measured upward from the free end 202E). Additionally or alternatively, the projection narrow sidewall 202NW may extend at an angle of from 0 degrees to 30 degrees with respect to the central axial direction A of the projection 202 over at least a portion of the longitudinal length L. Similarly, this angular feature may be present, for example, over a majority, at least 60%, at least 70%, at least 80%, at least 90%, at least 95%, or even all of the longitudinal length L of an individual projection 202 (e.g., measured upward from the free end 202E).

Also, as shown in FIG. 7C, in this illustrated example, at least some of the individual projections 202 (and optionally a majority, at least 60%, at least 70%, at least 80%, at least 90%, at least 95%, or even all of the individual projections 202) of the projection field 200 may have: (a) a wide side width dimension at the top WWT (where the projection 202 extends from the projection field base 210B), (b) a wide side bottom dimension WWB (at the free end 202E), and (c) a longitudinal length L extending from the top to the free end 202E. As shown in FIG. 7B, one or more of the projections 202 in the projection field 200 may include an angle $\alpha$ formed from the second surface 210G (ground-facing surface) of the projection field base 210B to the wide sidewall 202WW of the projection 202 over at least a portion of the longitudinal length L, e.g., in a range of 90 degrees to 140 degrees. Thus, the projection 202 may taper to its smallest transverse area at free end 202E. These angular and taper features may be present, for example, over a majority, at least 60%, at least 70%, at least 80%, at least 90%, at least 95%, or even all of the longitudinal length L of an individual projection 202 (e.g., measured upward from the free end 202E). Additionally or alternatively, the projection wide sidewall 202WW may extend at an angle of from 0 degrees to 30 degrees with respect to the central axial direction A of the projection 202 over at least a portion of the longitudinal length L. Similarly, this angular feature may be present, for example, over a majority, at least 60%, at least 70%, at least 80%, at least 90%, at least 95%, or even all of the longitudinal length L of an individual projection 202 (e.g., measured upward from the free end 202E).

For the specific example shown in FIGS. 7A-7C, the projection field 200 and/or at least some of the individual projections 202 (and optionally a majority, at least 60%, at least 70%, at least 80%, at least 90%, at least 95%, or even all of the individual projections 202 of the projection field 200) may have one or more of the following properties: (a) a polygonal (e.g., parallelogram, rectangular, rounded rectangular, square, etc.) transverse cross section (transverse to the longitudinal length L with the projection L oriented straight); (b) WWT=8 mm (or within the range of between 2 mm and 12 mm); (c) WWB=6 mm or less (or within the range of 1 mm to 10 mm); (d) WWT/WWB=1.3 (or within a range of 1 to 12); (e) WNT=4 mm (or within the range of between 1 mm and 8 mm); (f) WNB=1 mm or less (or within the range of 0 mm to 3 mm); (g) WNT/WNB=4 (or within a range of 1.25 to infinity); (h) length L=24 mm (or within the range of 4 mm to 36 mm); (i) WWT/WNT=2 (or within the range of 1.25 to 8); (j) L/WWT=3 (or within the range of 1.5 to 20); (k) L/WNT=6 (or within the range of 2 to 40); and/or (l) minimum axial length having transverse cross sectional area less than 100 $mm^2$=at least 4 mm (or within a range of 4 mm to 36 mm, e.g., measured upward from the free end 202E).

Figure 8A:
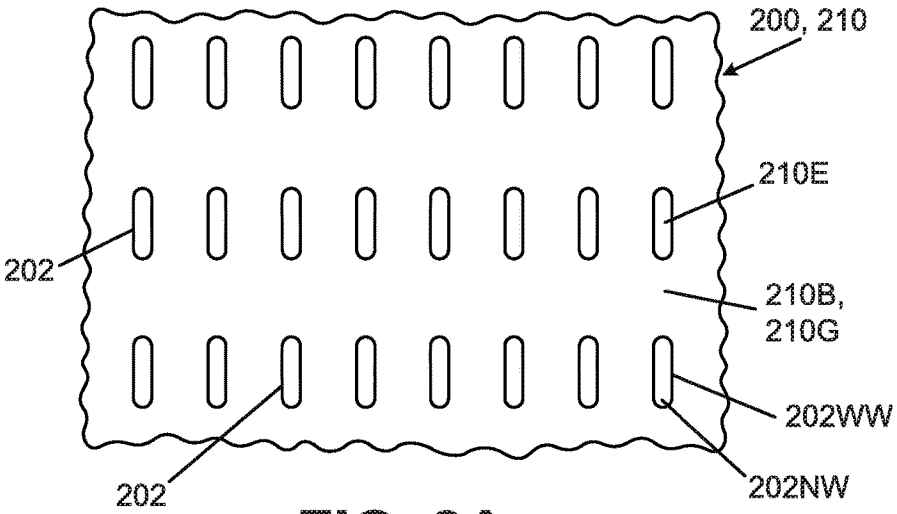
Figure 8C:
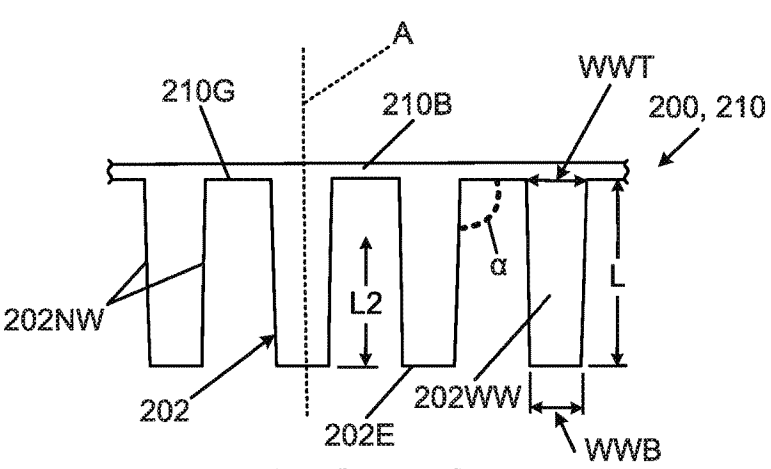
Figure 8B:
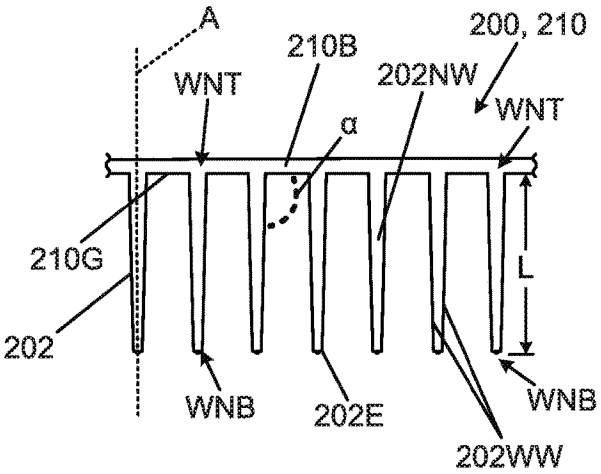

FIG. 8A provides a partial bottom view of an example projection field 200, FIG. 8B provides a narrow side (polygon narrow side) view of the projection field 200, and FIG. 8C provides a wide side (polygon wide side) view of the projection field 200. The example of FIGS. 7A-7C has a greater amount of taper or greater taper angle from base 201B (e.g., more "doorstop" or "wedge" shaped) as compared to the example of FIGS. 8A-8C (which is more "fin" shaped). As shown in FIGS. 8A to 8C, the projection field 200 of this example may include rows of projections 202 having a longitudinal length L and a generally rectangular transverse cross-sectional shape. FIGS. 8B and 8C show that an individual projection 202 may originate at or extend from the projection field base 210B and extend to a free end 202E. The longitudinal length L extends between the projection origination point (e.g., at projection field base 210B) and the free end 202E. To measure this longitudinal length L, it may be necessary to extend the projection 202 to its full length (e.g., if the projection 202 has a curved or bent shape).

As shown in FIG. 8B, in this illustrated example, at least some of the individual projections 202 (and optionally a majority, at least 60%, at least 70%, at least 80%, at least 90%, at least 95%, or even all of the individual projections 202) of the projection field 200 may have: (a) a narrow side width dimension at the top WNT (where the projection 202 extends from the projection field base 210B), (b) a narrow side bottom dimension WNB (at the free end 202E), and (c) a longitudinal length L extending from the top to the free end 202E. As shown in FIG. 8C, one or more of the projections 202 in the projection field 200 may include an angle α formed from the second surface 210G (ground-facing surface) of the projection field base 210B to the narrow sidewall 202NW of the projection 202 over at least a portion of the longitudinal length L, e.g., in a range of 90 degrees to 140 degrees. Thus, the projection 202 may taper to its smallest transverse cross-sectional area at free end 202E. These angular and taper features may be present, for example, over a majority, at least 60%, at least 70%, at least 80%, at least 90%, at least 95%, or even all of the longitudinal length L of an individual projection 202 (e.g., measured upward from the free end 202E). Additionally or alternatively, the projection narrow sidewall 202NW may extend at an angle of from 0 degrees to 30 degrees with respect to the central axial direction A of the projection 202 over at least a portion of the longitudinal length L. Similarly, this angular feature may be present, for example, over a majority, at least 60%, at least 70%, at least 80%, at least 90%, at least 95%, or even all of the longitudinal length L of an individual projection 202 (e.g., measured upward from the free end 202E).

Also, as shown in FIG. 8C, in this illustrated example, at least some of the individual projections 202 (and optionally a majority, at least 60%, at least 70%, at least 80%, at least 90%, at least 95%, or even all of the individual projections 202) of the projection field 200 may have: (a) a wide side width dimension at the top WWT (where the projection 202 extends from the projection field base 210B), (b) a wide side bottom dimension WWB (at the free end 202E), and (c) a longitudinal length L extending from the top to the free end 202E. As shown in FIG. 8B, one or more of the projections 202 in the projection field 200 may include an angle α formed from the second surface 210G (ground-facing surface) of the projection field base 210B to the wide sidewall 202WW of the projection 202 over at least a portion of the longitudinal length L, e.g., in a range of 90 degrees to 140 degrees. Thus, the projection 202 may taper to its smallest transverse cross-sectional area at its free end 202E. These angular and taper features may be present, for example, over a majority, at least 60%, at least 70%, at least 80%, at least 90%, at least 95%, or even all of the longitudinal length L of an individual projection 202 (e.g., measured upward from the free end 202E). Additionally or alternatively, the projection wide sidewall 202WW may extend at an angle of from 0 degrees to 30 degrees with respect to the central axial direction A of the projection 202 over at least a portion of the longitudinal length L. Similarly, this angular feature may be present, for example, over a majority, at least 60%, at least 70%, at least 80%, at least 90%, at least 95%, or even all of the longitudinal length L of an individual projection 202 (e.g., measured upward from the free end 202E).

For the specific example shown in FIGS. 8A-8C, the projection field 200 and/or at least some of the individual projections 202 (and optionally a majority, at least 60%, at least 70%, at least 80%, at least 90%, at least 95%, or even all of the individual projections 202 of the projection field 200) may have one or more of the following properties: (a) a polygonal (e.g., parallelogram, rectangular, rounded rectangular, square, etc.) transverse cross section (transverse to the longitudinal length L with the projection L oriented straight); (b) WWT=7.5 mm (or within the range of between 2 mm and 12 mm); (c) WWB=7 mm or less (or within the range of 1 mm to 10 mm); (d) WWT/WWB=1.07 (or within a range of 1 to 12); (e) WNT=1.5 mm (or within the range of between 1 mm and 8 mm); (f) WNB=1 mm or less (or within the range of 0 mm to 3 mm); (g) WNT/WNB=1.5 (or within a range of 1.1 to infinity); (h) length L=24 mm (or within the range of 4 mm to 36 mm); (i) WWT/WNT=5 (or within the range of 2 to 20); (j) L/WWT=3.2 (or within the range of 1.5 to 20); (k) L/WNT=16 (or within the range of 2 to 40); and/or (l) minimum axial length having transverse cross sectional area less than 100 $mm^2$=at least 4 mm (or within a range of 4 mm to 36 mm, e.g., measured upward from the free end 202E).

The examples of FIGS. 7A to 8C show projections 202 having rectangular or non-square parallelogram transverse cross sections. For projections 202 having a rounded rectangular or parallelogram shape, the term "wide side" in the discussion and equations above (and the discussion below) may be interpreted as the widest or largest transverse cross sectional dimension of the projection 202, and the term "narrow side" in the discussion and equations above (and the discussion below) may be interpreted as the narrowest or smallest transverse cross sectional dimension of the projection 202. The same values and/or ranges of values described above for the examples of FIGS. 7A to 8C apply to the widest or largest transverse cross sectional dimensions and the narrowest or smallest transverse cross sectional dimensions of such other rounded rectangular or parallelogram shaped projections 202. For projections 202 having a square transverse cross section, the sides may have any of the "wide side" or "narrow side" features described above. As some more specific examples, at least 20 projections 202 in projection fields 200 of the types shown in FIGS. 7A-8C may have one or more of the following properties: a polygonal transverse cross sectional shape with a largest polygon side dimension of 10 mm or less; a rectangular or parallelogram transverse cross sectional shape with a wide side dimension of 10 mm or less and a narrow side dimension of 6 mm or less; a rectangular or parallelogram transverse cross sectional shape with a wide side dimension of 8 mm or less and a narrow side dimension of 5 mm or less; a tapered shape along the length dimension L to a smallest transverse cross sectional size and/or area at the free ends 202E of the respective projection 202. Any of the above properties also may apply to at least 25 projections 202, at least 30 projections 202, at least 35 projections 202, at least 40 projections 202, or even at least 50 projections 202 in a projection field 200.

In accordance with at least some examples of this technology, when including projections 202 having polygonal, parallelogram, rectangular, square, or rounded rectangular transverse cross sections in a projection field 200, at least some of the individual projections 202 (and optionally at least 25%, at least 40%, at least 50%, at least 60%, at least 70%, at least 80%, at least 90%, at least 95%, or even all of the individual projections 202) of the projection field 200 may have one or more and/or any combination of the properties and/or property values set forth in Table 2 below:

TABLE 2

| Parameter | Value A | Value B | Value C |
|---|---|---|---|
| Wide Side Top Dimension (WWT) | Less than 15 mm | Less than 12 mm | Less than 10 mm |
| Wide Side Bottom Dimension (WWB) | Less than 12 mm | Less than 10 mm | Less than 8 mm |
| Length Dimension (L) | At least 10 mm | At least 15 mm | At least 20 mm |
| Wide Side Top Dimension (WWT) | 3 mm to 15 mm | 4 mm to 12 mm | 5 mm to 10 mm |
| Wide Side Bottom Dimension (WWB) | 1 mm to 12 mm | 2 mm to 10 mm | 3 mm to 8 mm |
| Length Dimension (L) | 4 mm to 36 mm | 8 mm to 30 mm | 10 mm to 26 mm |
| Length Having Wide Side Dimension Less Than 15 mm* | At least 4 mm | 4 mm to 36 mm | 6 mm to 30 mm |
| Length Having Wide Side Dimension Less Than 12 mm* | At least 4 mm | 6 mm to 36 mm | 10 mm to 30 mm |
| Length Having Wide Side Dimension Less Than 10 mm* | At least 4 mm | 6 mm to 36 mm | 10 mm to 30 mm |
| WWT/WWB | 1 to 12 | 1 to 8 | 1.05 to 5 |
| L/WWT | 1.5 to 25 | 2 to 20 | 2.5 to 15 |
| Narrow Side Top Dimension (WNT) | Less than 8 mm | Less than 6 mm | Less than 5 mm |
| Narrow Side Bottom Dimension (WNB) | Less than 5 mm | Less than 4 mm | Less than 3 mm |
| Narrow Side Top Dimension (WNT) | 1 mm to 8 mm | 2 mm to 6 mm | 2.5 mm to 5 mm |
| Narrow Side Bottom Dimension (WNB) | 0 mm to 5 mm | 0.25 mm to 4 mm | 0.5 mm to 3 mm |
| WNT/WNB | 1 to infinity | 1.25 to 40 | 1.5 to 25 |
| L/WNT | 2 to 50 | 3 to 40 | 4 to 25 |
| WWT/WNT | 1.1 to 16 | 1.2 to 10 | 1.25 to 8 |
| WWB/WNB | 1.1 to infinity | 3 to 50 | 4 to 30 |
| Length Having Transverse Cross Sectional Area Less Than 150 $mm^2$* | At least 4 mm | 4 mm to 36 mm | 6 mm to 30 mm |
| Length Having Transverse Cross Sectional Area Less Than 120 $mm^2$* | At least 4 mm | 6 mm to 36 mm | 10 mm to 30 mm |
| Length Having Transverse Cross Sectional Area Less Than 100 $mm^2$* | At least 4 mm | 6 mm to 36 mm | 10 mm to 30 mm |
| Base to Wide Sidewall Angle (or Taper Angle)** | 90 degrees to 140 degrees | 95 degrees to 130 degrees | 98 degrees to 120 degrees |
| Base to Narrow Sidewall Angle (or Taper Angle)** | 90 degrees to 140 degrees | 95 degrees to 130 degrees | 98 degrees to 120 degrees |

*The "Length" having the various transverse cross sectional area features may be less than the full longitudinal length L of the projection 202 (i.e., a portion of the length L of the projection 202), and this length or length portion may be measured from an origin point located at the free end 202E of the projection 202. Note dimension L2 in FIGS. 7C and 8C.

**The angular values need not be included over the entire longitudinal length L of the projection 202, but may be present, for example, over at least 50% of the projection's longitudinal length, optionally at the bottom half of the projection's longitudinal length L.

In some examples of this technology, one or more of the primary traction elements 110M and 110L will have a transverse cross sectional diameter (D1), largest transverse cross sectional dimension (D2), and/or transverse cross sectional area (A1): (a) at a location halfway down their longitudinal length and/or (b) at a location 5 mm upward from their free ends 110E that is at least 3 times greater than the transverse cross sectional diameter (D3), largest transverse cross sectional dimension (D4), and/or transverse cross sectional area (A2) of a majority of the projections 202 in the projection field 200 (and in some examples, at least 75%, at least 85%, at least 90%, at least 95%, or even all of the projections 202 in the projection field 200): (a) at locations halfway down their respective longitudinal length and/or at a location 5 mm upward from their free ends 202E. As some more specific examples, at least one of the primary traction elements 110M, 110L (and optionally, at least 50% of the primary traction elements 110L, 110M, or even all of the primary traction elements 110L, 110M (at least in the forefoot region)) may have one or more of the following features with respect to at least a majority (and in some examples, at least 75%, at least 85%, at least 90%, at least 95%, or even all of the projections 202 in the projection field 200):

| | | |
|---|---|---|
| $D1 \geq 3 \times D3$ | $D2 \geq 3 \times D4$ | $A1 \geq 3 \times A2$ |
| $D1 \geq 4 \times D3$ | $D2 \geq 4 \times D4$ | $A1 \geq 4 \times A2$ |
| $D1 \geq 6 \times D3$ | $D2 \geq 6 \times D4$ | $A1 \geq 6 \times A2$ |

-continued

| | | |
|---|---|---|
| D1 ≥ 8 × D3 | D2 ≥ 8 × D4 | A1 ≥ 8 × A2 |
| D1 ≥ 10 × D3 | D2 ≥ 10 × D4 | A1 ≥ 10 × A2 |

wherein: (a) D1 corresponds to a transverse cross sectional diameter of the primary traction element 110M, 110L at a location halfway down its longitudinal length L and/or a transverse cross sectional diameter of the primary traction element 110M, 110L at a location 5 mm upward from its free end 110E; (b) D2 corresponds to a largest transverse cross sectional dimension of the primary traction element 110M, 110L at a location halfway down its longitudinal length L and/or a largest transverse cross sectional dimension of the primary traction element 110M, 110L at a location 5 mm upward from its free end 110E; (c) A1 corresponds to a transverse cross sectional area of the primary traction element 110M, 110L at a location halfway down its longitudinal length L and/or a transverse cross sectional area of the primary traction element 110M, 110L at a location 5 mm upward from its free end 110E; (d) D3 corresponds to a transverse cross sectional diameter of a projection 202 at a location halfway down its longitudinal length L and/or a transverse cross sectional diameter of a projection 202 at a location 5 mm upward from its free end 110E; (e) D4 corresponds to a largest transverse cross sectional dimension of a projection 202 at a location halfway down its longitudinal length L and/or a largest transverse cross sectional dimension of a projection 202 at a location 5 mm upward from its free end 110E; and (f) A2 corresponds to a transverse cross sectional area of a projection 202 at a location halfway down its longitudinal length L and/or a transverse cross sectional area of a projection 202 at a location 5 mm upward from its free end 202E.

An individual or discrete projection field 200 need not have all projections 202 contained therein of substantially the same size and/or shape. Rather, if desired, different projection 202 sizes (e.g., diameters, dimensions, areas, lengths, taper angles, etc.) and/or shapes (e.g., rounded cross section, rectangular cross section, circular cross section, and/or other cross sections) may be provided within a single projection field 200 without departing from this technology. As some more specific examples, the longitudinal lengths L of the projections 202 may vary such that the free ends 202E of the projections 202 provide a contoured arrangement (e.g., with shorter projections 202 located toward a central area of the projection field 200, with shorter projections 202 located toward an outer perimeter of the projection field 200, etc.).

Projections 202 and projection fields 200 in accordance with at least some examples of this technology may have one or more and/or any combination of the properties and/or property values set forth in Table 3 below:

TABLE 3

| Parameter | Value A | Value B | Value C |
|---|---|---|---|
| Projection Field 200 Area | At least 900 $mm^2$ | At least 1200 $mm^2$ | At least 1600 $mm^2$ |
| Projection Field 200 Area | 900 $mm^2$ to 5000 $mm^2$ | 1200 $mm^2$ to 4000 $mm^2$ | 1600 $mm^2$ to 3600 $mm^2$ |
| Projection Field 200 Area | 900 $mm^2$ to 8000 $mm^2$ | 1200 $mm^2$ to 6000 $mm^2$ | 1600 $mm^2$ to 5000 $mm^2$ |
| Projection 202 Packing Density in the Projection Field 200 | At least 4 projections per square inch (at least 0.62 projections per square centimeter) | At least 6 projections per square inch (at least 0.93 projections per square centimeter) | At least 8 projections per square inch (at least 1.24 projections per square centimeter) |
| Projection 202 Packing Density in the Projection Field 200 | 3 to 24 projections per square inch (0.47 to 3.72 projections per square centimeter) | 4 to 20 projections per square inch (0.62 to 3.1 projections per square centimeter) | 6 to 16 projections per square inch (0.93 to 2.48 projections per square centimeter) |
| Total Number of Projections (N) 202 in Projection Field 200 | At least 20 | At least 35 | At least 50 |
| Total Number of Projections (N) 202 in Projection Field 200 | 20 to 250 | 35 to 225 | 50 to 200 |
| Total Number of Projections (N) 202 in Projection Field 200 | 20 to 120 | 30 to 90 | 35 to 75 |
| Hardness of Projection Material | 50 to 160 Shore A | 55 to 140 Shore A | 60 to 120 Shore A |
| Hardness of Projection 202 Material | 85 to 115 Shore A | 90 to 110 Shore A | 92 to 106 Shore A |
| Hardness of Projection 202 Material | 72 to 100 Shore A | 76 to 95 Shore A | 78 to 90 Shore A |
| Hardness of Projection 202 Material | 50 to 85 Shore A | 55 to 80 Shore A | 60 to 78 Shore A |

Figure 9A:
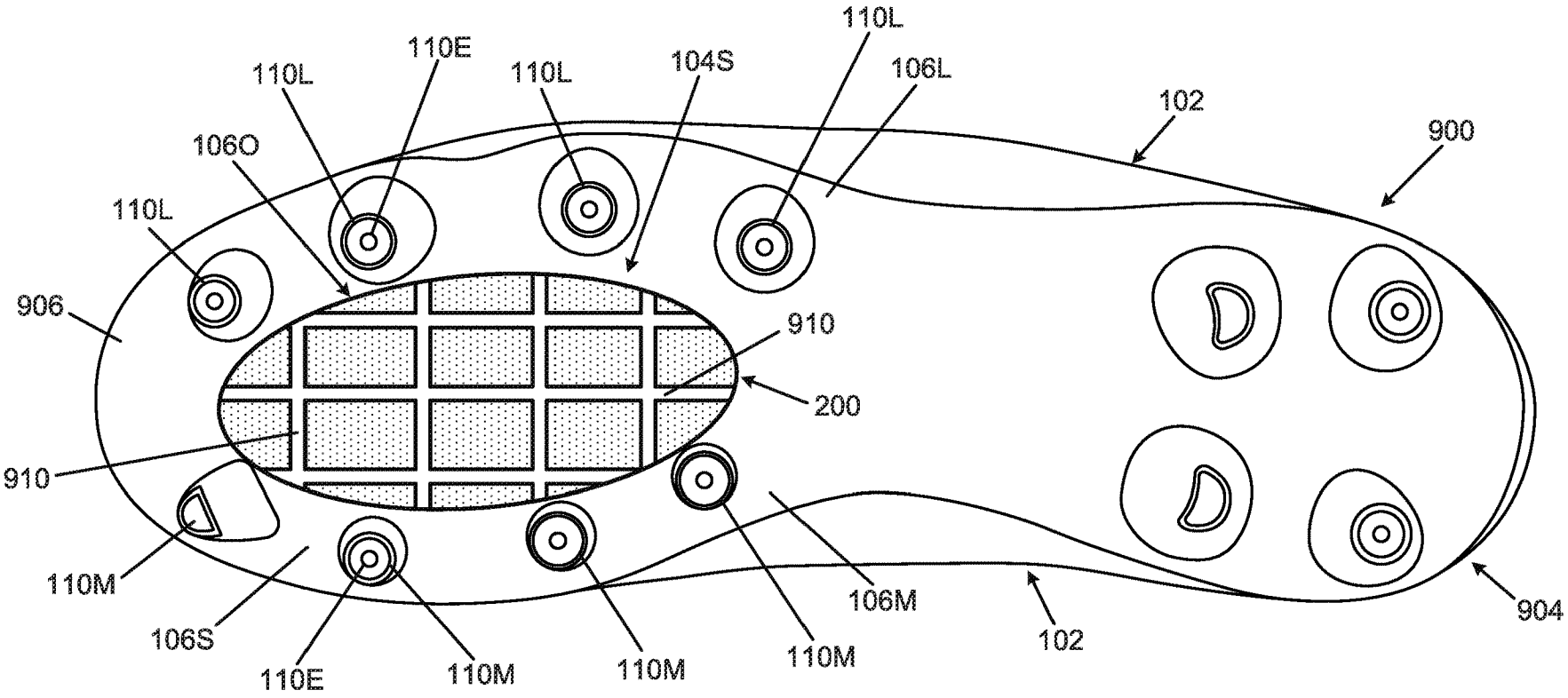
FIGS. 9A and 9B provide bottom views of other example articles of footwear and sole structures in accordance with aspects of this technology.
Figure 9B:
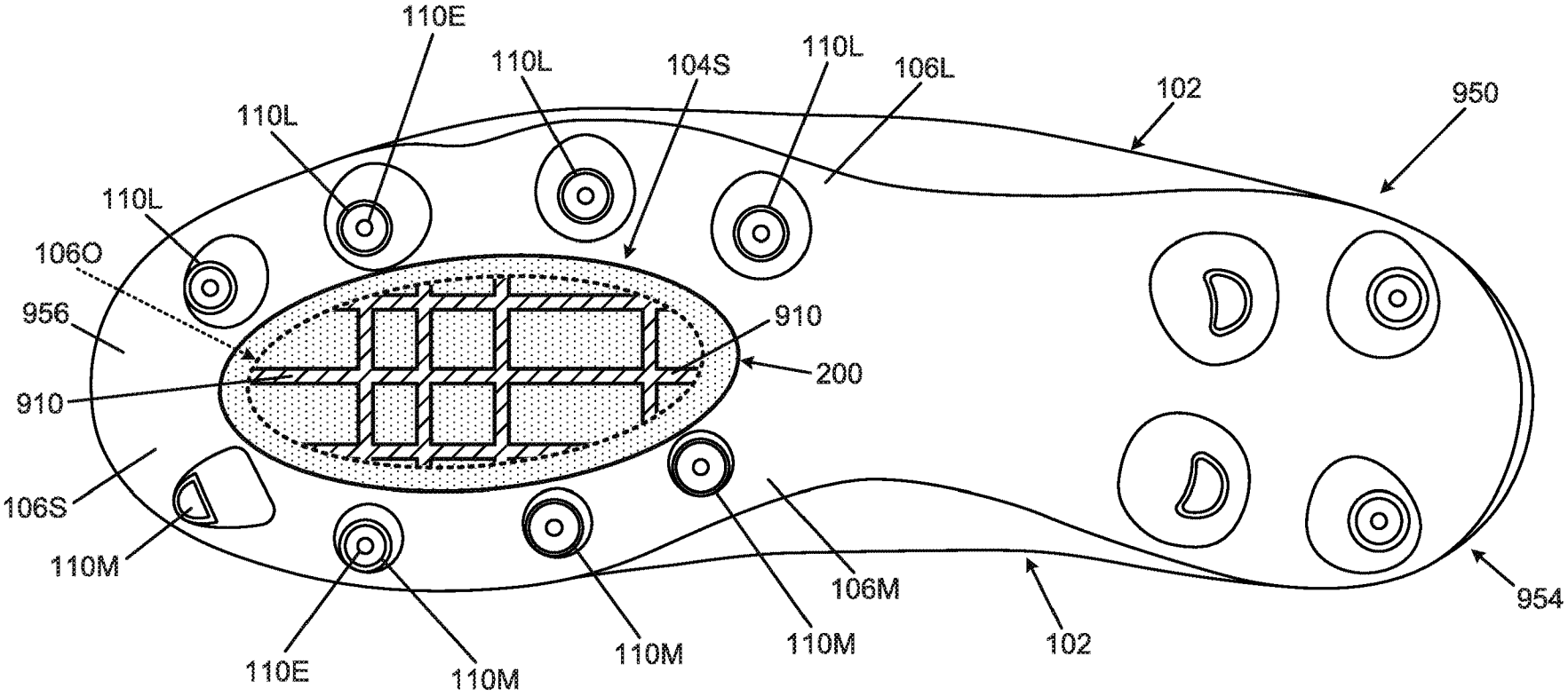

FIGS. 9A and 9B illustrate additional example articles of footwear 900, 950, sole structures 904, 954 and sole members 906, 956, in accordance with some examples of this technology. Like the examples described in conjunction with FIG. 2 above, these example sole structures 904, 954 and sole members 906, 956 define an opening 106O in the central space 104S defined between the interior-most extents of the primary traction elements 110L, 110M. Rather than a completely open opening 106O, however, the base surface 106S of the sole member 106 in these examples forms one or more support structures 910 across the opening 106O. One or more of the support structure(s) 910 may be integrally formed with the sole member 906, 956 and/or the sole structure 904, 954 when it is made (e.g., by molding techniques) and/or one or more of the support structure(s) 910 may be formed separately and then attached to the sole member 906, 956 and/or other part of the sole structure 904, 954 and/or footwear structure 900, 950 (e.g., by adhesives or cements, by mechanical fasteners, by fusing techniques, etc.).

In the example sole structure 904 and/or sole member 906 shown in FIG. 9A, the projection field 200 is mounted inside the support structure(s) 910 so that the support structure(s) 910 is (are) exposed at the exterior of the sole structure 904. This mounting may be accomplished, e.g., with an assembly and structure like that shown in FIG. 2 (e.g., with the second surface 210G of the projection field 200 engaged with the interior surface 106I of the sole member 906). Similarly, in this arrangement, the second surface 210G of the projection field 200 will be engaged with the interior surface of the support structure(s) 910. The projection field 200 may be formed (e.g., during a molding process) to include one or more gaps between projections 202 and/or sets of projections 202 to accommodate placement and receipt of a corresponding support structure 910. As other options or alternatives, projections 202 could be trimmed off an existing projection field 200 to provide gaps to accommodate the support structure 910 and/or projections 202 could be added to a projection field base 210B after the projection field 200 is engaged with the support structure 910, sole structure 904, and/or sole member 906.

In the example sole structure 954 and/or sole member 956 shown in FIG. 9B, the projection field 200 is mounted outside the support structure(s) 910 so that the support structure(s) 910 is not (are not) exposed at the exterior of the sole structure 954. This mounting may be accomplished by engaging the first surface 210U of the projection field 200 with the exterior surface 106X of the sole member 956 and covering an opening 106O. Similarly, in this arrangement, the first surface 210U of the projection field 200 will be engaged with (and cover) the exterior surface of the support structure(s) 910 that extend across an opening 106O. In this example footwear structure 950, the projection field 200 need not be formed to include one or more gaps between projections 202 and/or sets of projections 202 for support structure(s) 910 because the support structure(s) 910 are located inside the projection field 200.

Any desired number, positioning, and/or shape of support structure 910 may be provided without departing from aspects of this technology. In the illustrated examples of FIGS. 9A and 9B, the base surface 106S of the sole member 906, 956 is formed to include a two-dimensional matrix or monolithic structure as the support structure 910 that extends across the opening 106O to divide the opening 106O into a plurality of openings separated by the matrix/monolithic structure. The support member(s) 910 may be positioned to provide a desired level of support across the opening 106O while still accommodating transmission of forces from the projections 202 (e.g., due to contact with a ball) to the wearer's foot in the manner described above.

As noted above, the projections 202 included in sole structures 104, 404, 904, 954 in accordance with this technology are designed to readily bend under the weight of a wearer. Thus, the free ends 202E of the projections 202 are not intended to substantially penetrate and/or dig into the ground surface and/or to provide substantial traction for the wearer's foot by penetrating and/or digging into the ground surface. Rather, the projections 202 are intended to engage a ball (and potentially provide some ball gripping action) and help the user "feel" and control the ball and/or provide audio feedback of contact between the ball and the foot. Various features of the projections 202, the projection field 200, the sole structure 104, 404, 904, 954 and the article of footwear 100, 400, 900, 950 may be selected and varied to provide the desired "feedback" and control features, such as: the density of the projections 202 in one or more areas of the projection field 200; the heights of the projections 202 in one or more areas of the projection field 200; the hardness of the material of the projections 202; the thickness of the projection field base 210B; the presence, absence, and/or locations of the sole member opening 106O, and/or support structures 910; the thickness of the sole member 106 above the projection field; etc. Harder projections may tend to increase force transmission and feedback to the foot, increase the audible feedback, etc.

If necessary or desired, the projections 202 and/or projection field 200 may be formed of or include a material that helps avoid dirt, grass, and other materials from sticking to them/it, such as a hydrophobic coating material. As some more specific examples, the projections 202 and/or projection field 200 may be formed from and/or treated by materials used in clog resistant and/or anti-clog soccer shoes available from NIKE®, Inc. (and/or otherwise use the anti-clog structures and/or technology provided in such soccer shoes).

Figure 10:
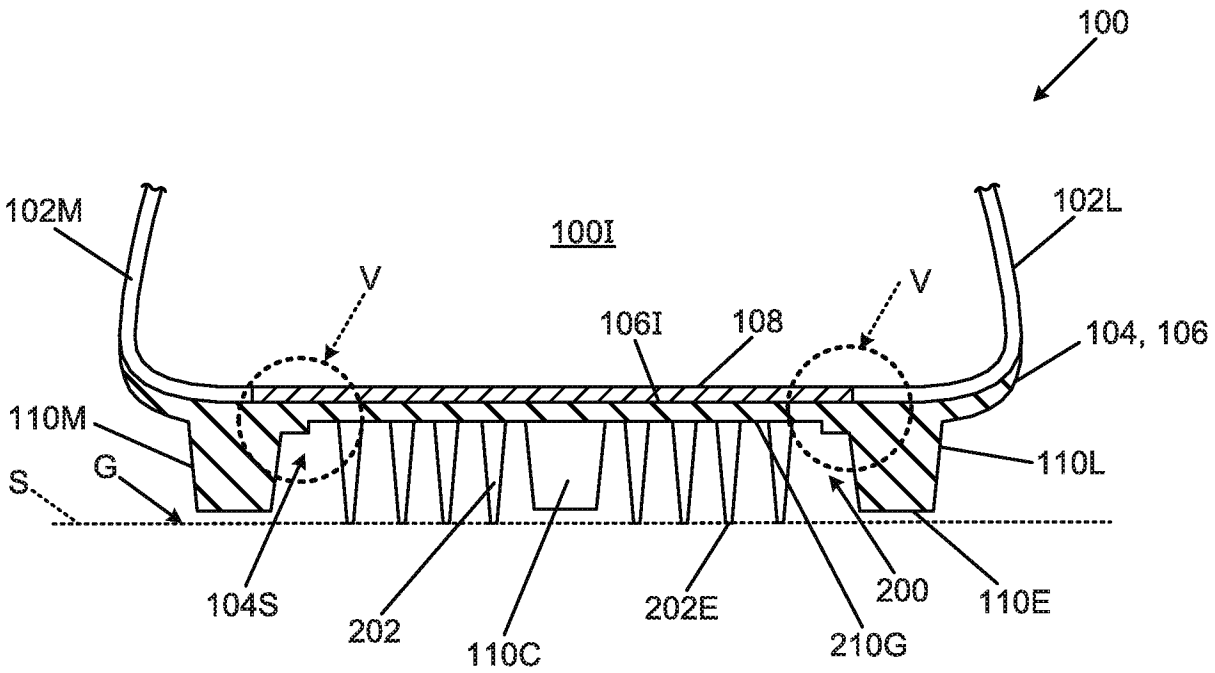
FIG. 10 provides a partial vertical cross sectional view through footwear having a projection field, e.g., at section line 2,3-2,3 of FIG. 1A, showing additional and/or alternative features of an article of footwear and/or sole structure in accordance with examples of this technology.

Some additional and/or alternative features of footwear 100 and/or sole structures 104 in accordance with examples of this technology are shown in FIG. 10. FIG. 10 is similar to FIGS. 2 and 3, and where the same reference numbers are used in FIG. 10 as in FIGS. 2 and/or 3 (and/or other figures), that reference number refers to the same part or a similar part (and the corresponding repetitive description is omitted). FIGS. 2 and 3 show the projection field 200 as a separate part engaged with another sole member 104 part and/or a footwear upper 102 part (such as strobel 108). In the example structure shown in FIG. 10, however, the projection field 200 is integrally formed as part of a sole structure 104 component (e.g., integrally formed with an outsole component that includes primary traction elements 110L and 110M (or mounts therefor, if primary traction elements 110L and/or 110M are detachable) in this illustrated example). In this manner, the projection field 200 may be integrally formed with at least one sole component part, e.g., by molding techniques (such as injection molding). As shown in circled areas V in FIG. 10, if desired (but not a requirement in all examples), the sole base 106S may include a "thinned area" corresponding to at least some portion of the projection field 200, e.g., the ground facing surface 210G. This "thinned area" may better transmit forces incident on the projections 202 (e.g., from contact with a ball) to the wearer's foot. These "integrally formed" projection field 200 features may be provided in any examples of the technology described above, and may include any options thereof, any projection shapes, any of the options in Tables 1-3, etc.

Also, while the examples of FIGS. 1A-9B show projection fields 200 devoid of primary traction elements, this is not a requirement. FIG. 10 further shows that the projection field 200 may include at least one primary traction element 110C within it (and optionally, two or more primary traction elements 110C). In this illustrated example, at least some of the projections 202, when fully extended, extend beyond the free end of the primary traction elements 110L, 110M, and/or 110C.

Figure 11:
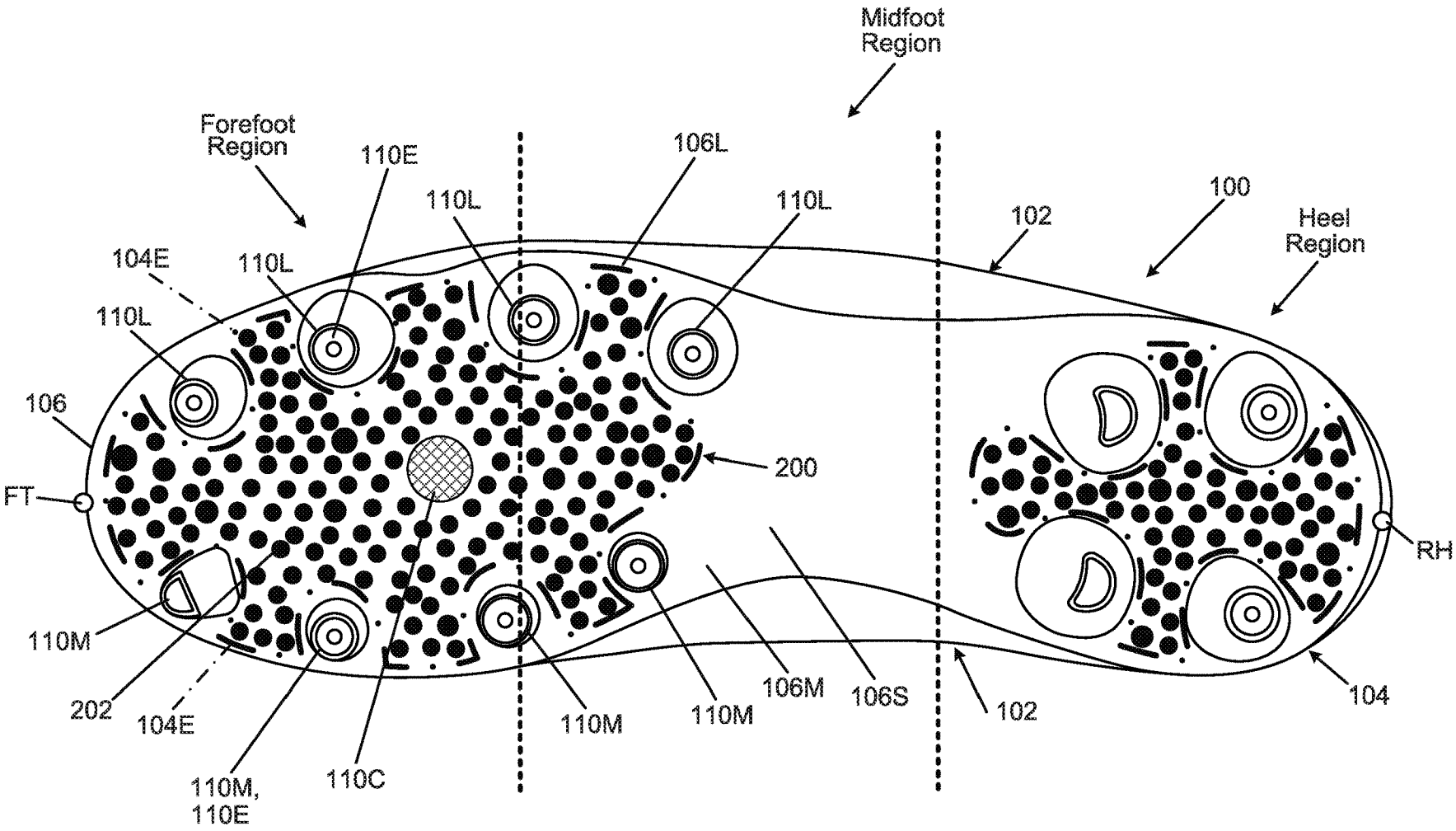
FIG. 11 provides a bottom view of a sole structure that includes additional and/or alternative features of an article of footwear and/or sole structure in accordance with examples of this technology.

Similarly, FIG. 11 shows an example footwear 100/sole structure 104 that includes a centrally located primary traction element 110C within a projection field 200. Thus, this centrally located primary traction element 110C has projections 202 located all around it (and surrounding it). If desired, two or more primary traction elements 110C may be located within a projection field 200 and have projections 202 at least partially or fully surrounding them.

FIG. 11 illustrates other potential features as well. FIG. 11 is similar to FIGS. 1B and 4, and where the same reference numbers are used in FIG. 11 as in FIGS. 1B and/or 4 (and/or other figures), that reference number refers to the same part or a similar part (and the corresponding repetitive description is omitted). FIG. 1B shows the projection field 202 contained wholly within the central area between in the innermost extents of the side primary traction elements 110L, 110M. This is not a requirement. Rather, as shown in the example structure of FIG. 11, the projection field 200 may extend into areas between the primary traction elements 110L and/or 110M on one or both sides of the sole structure 104. Thus, the projection field 200 and individual projections 202 thereof may extend into and/or be included in any one or more of the areas enclosed within the dot-dash lines of FIG. 11 and between primary cleats 110L and/or 110M on one side (or both sides) of the sole structure 104. Thus, the projection field 200 is not limited to the central area between a lateral set of primary cleats 110L and a medial set of primary cleats 110M. Additionally or alternatively, the projection field 200 and/or individual projections 202 thereof also may be provided in the forward toe area and/or the heel area, if desired (as shown by the enclosed areas in dot-dash lines in those regions).

While specific areas between the dot-dash lines are shown in FIG. 11, the projection field 200 in any one or more of those areas, when present, may have any shape and/or any number of individual projections 200. Further, the projection field(s) 200, when included in any one or more of these additional areas shown in FIG. 11, may have any of the structures and/or characteristics of projection fields 200 and/or individual projections 202 described above in conjunction with any of the figures and/or as described above in one or more of Tables 1-3.

Further, while not shown in these figures, sole structures 104, 404, 904, 954 in accordance with examples of this invention further may include one or more midsole components incorporated into its structure. Such midsole component(s) may include one or more of: foam material(s), one or more fluid-filled bladders, mechanical shock absorbing components, etc. Such midsole component(s), when present, may be located inside the upper 102 (e.g., inside the foot-receiving chamber 100I), outside the upper 103 (e.g., between the upper 102 and sole member 106, 406, 906, 956, in both locations, etc.).

III. CONCLUSION

The present invention is disclosed above and in the accompanying drawings with reference to a variety of embodiments and/or options. The purpose served by the disclosure, however, is to provide examples of various features and concepts related to the invention, not to limit the scope of the invention. One skilled in the relevant art will recognize that numerous variations and modifications may be made to the features of the invention described above without departing from the scope of the present invention, as defined by the appended claims.

For the avoidance of doubt, the present application includes at least the subject matter described in the following numbered Clauses:

Clause 1. A sole structure having a ground-facing surface and an upper-facing surface, the sole structure comprising:

a sole member made from one or more parts and including a base surface, a medial side, and a lateral side, wherein the sole member includes a first sole part and a projection field engaged with or integrally formed with the first sole part, wherein the projection field comprises a plurality of projections that extend beyond the base surface and have exposed free ends, wherein the plurality of projections includes at least 20 projections having a projection packing density of at least 4 projections per square inch (0.62 projections per square centimeter) in the projection field (e.g., the projection field may define an area of at least 900 $mm^2$ with projections dispersed throughout), wherein a first subset of the plurality of projections have a length of at least 5 mm, and wherein at least a majority of the plurality of projections in the projection field readily bend under force applied by weight of a user of the sole structure.

Clause 2. A sole structure having a ground-facing surface and an upper-facing surface, the sole structure comprising:

a sole member made from one or more parts and including a base surface, a medial side, and a lateral side;

a plurality of primary traction elements extending in a direction away from the base surface, wherein each traction element of the plurality of primary traction elements extends from the base surface to a free end surface; and a projection field engaged with or integrally formed with at least one or more parts of the sole member, wherein the projection field comprises a plurality of projections that extend beyond the base surface and have exposed free ends, wherein the plurality of projections includes at least 20 projections in the projection field, wherein at least a majority of the plurality of projections in the projection field readily bend under force applied by weight of a user of the sole structure, and wherein with the sole structure supported on its ground-facing surface on a horizontal support surface, a first subset of the plurality of projections have a longitudinal length when fully extended so that their free ends extend toward the horizontal support surface beyond the free end of a closest primary traction element to the respective projection of the first subset.

Clause 3. A sole structure having a ground-facing surface and an upper-facing surface, the sole structure comprising:

a sole member made from one or more parts and including a base surface, a medial side, and a lateral side;

a plurality of medial side primary traction elements located on the medial side of the sole member and extending in a direction away from the base surface;

a plurality of lateral side primary traction elements located on the lateral side of the sole member and extending in a direction away from the base surface;

a central space defined between interior extents of the plurality of medial side primary traction elements and the plurality of lateral side primary traction elements; and a projection field located at least partially in the central space, wherein the projection field comprises a plurality of projections that extend beyond the base surface and have exposed free ends, wherein the plurality of projections includes at least 20 projections having a projection packing density of at least 4 projections per square inch (0.62 projections per square centimeter) in the projection field (e.g., wherein the projection field defines an area of at least 900 $mm^2$ with projections dispersed throughout), wherein a first subset of the plurality of projections have a length of at least 8 mm, and wherein at least a majority of the plurality of projections in the projection field readily bend under force applied by weight of a user of the sole structure.

Clause 4. A sole structure having a ground-facing surface and an upper-facing surface, the sole structure comprising:

a sole member made from one or more parts and including a base surface, a medial side, and a lateral side;

a plurality of medial side primary traction elements located on the medial side of the sole member and extending in a direction away from the base surface, wherein each traction element of the plurality of medial side primary traction elements extends from the base surface to a free end surface;

a plurality of lateral side primary traction elements located on the lateral side of the sole member and extending in a direction away from the base surface, wherein each traction element of the plurality of lateral side primary traction elements extends from the base surface to a free end surface;

a central space defined between interior extents of the plurality of medial side primary traction elements and the plurality of lateral side primary traction elements; and a projection field located at least partially in the central space, wherein the projection field comprises a plurality of projections that extend beyond the base surface and have exposed free ends, wherein the plurality of projections includes at least 20 projections in the projection field, wherein at least a majority of the plurality of projections in the projection field readily bend under force applied by weight of a user of the sole structure, and wherein with the sole structure supported on its ground-facing surface on a horizontal support surface, a first subset of the plurality of projections have a longitudinal length when fully extended so that their free ends extend toward the horizontal support surface beyond the free end of a closest primary traction element to the respective projection of the first subset.

Clause 5. The sole structure according to any one of Clauses 1-4, wherein the projection field includes a projection field base having a first surface and a second surface opposite the first surface, and wherein the plurality of projections originate at the second surface and extend from the projection field base in a direction away from the first surface and the second surface.

Clause 6. The sole structure according to Clause 5, wherein the base surface of the sole member includes an interior surface and an exterior surface opposite the interior surface, wherein the base surface has an opening defined through it that extends completely from the interior surface to the exterior surface, wherein the second surface of the projection field base is engaged with the interior surface of the base surface, and wherein the plurality of projections extend through the opening.

Clause 7. The sole structure according to Clause 6, wherein the opening has a size of at least 2500 $mm^2$.

Clause 8. The sole structure according to Clause 6 or 7, wherein the base surface includes a matrix structure that extends across the opening to divide the opening into a plurality of openings separated by the matrix structure, and wherein the second surface of the projection field base contacts an interior surface of the matrix structure.

Clause 9. The sole structure according to Clause 5, wherein the base surface of the sole member includes an interior surface and an exterior surface opposite the interior surface, wherein the base surface has an opening defined through it that extends completely from the interior surface to the exterior surface, wherein: (a) at a first portion of the projection field, the second surface of the projection field base is engaged with the interior surface of the base surface and the plurality of projections extend through the opening, and (b) at a second portion of the projection field, the first surface of the projection field base is engaged with the exterior surface of the base surface of the sole member.

Clause 10. The sole structure according to Clause 9, wherein the first portion of the projection field is located primarily in a forefoot region of the sole structure, and wherein the second portion of the projection field is located primarily in a midfoot region of the sole structure.

Clause 11. The sole structure according to Clause 5, wherein the first surface of the projection field base is engaged with an exterior surface of the base surface of the sole member.

Clause 12. The sole structure according to any preceding Clause, wherein an area defined within outermost extents of the plurality of projections in the projection field covers at least 2400 $mm^2$.

Clause 13. The sole structure according to any preceding Clause, wherein at least a majority of the projection field is located in a forefoot region of the sole structure.

Clause 14. The sole structure according to any one of Clauses 1-13, wherein the projection field extends continuously from a forefoot region to a midfoot region of the sole structure.

Clause 15. The sole structure according to any preceding Clause, wherein at least 20 projections of the plurality of projections have a largest transverse cross sectional dimension of 8 mm or less.

Clause 16. The sole structure according to any one of Clauses 1-14, wherein at least 20 projections of the plurality of projections have a largest transverse cross sectional dimension of 5 mm or less.

Clause 17. The sole structure according to any one of Clauses 1-14, wherein at least 20 projections of the plurality of projections have a rounded transverse cross sectional shape with a diameter of 8 mm or less.

Clause 18. The sole structure according to any one of Clauses 1-14, wherein at least 20 projections of the plurality of projections have a rounded transverse cross sectional shape with a diameter of 5 mm or less.

Clause 19. The sole structure according to any one of Clauses 1-14, wherein at least 20 projections of the plurality of projections have a rounded transverse cross sectional shape with a diameter of 3 mm or less.

Clause 20. The sole structure according to any one of Clauses 1-14, wherein at least 20 projections of the plurality of projections have a polygonal transverse cross sectional shape with a largest polygon side dimension of 8 mm or less.

Clause 21. The sole structure according to any one of Clauses 1-14, wherein at least 20 projections of the plurality of projections have a rectangular transverse cross sectional shape with a wide side dimension of 8 mm or less and a narrow side dimension of 4 mm or less.

Clause 22. The sole structure according to any one of Clauses 1-14, wherein at least 20 projections of the plurality of projections have a rectangular transverse cross sectional shape with a wide side dimension of 6 mm or less and a narrow side dimension of 3 mm or less.

Clause 23. The sole structure according to any one of Clauses 15-22, wherein said at least 20 projections taper in cross sectional shape in their length dimensions to a smallest transverse cross sectional size at the free ends of the respective projections.

Clause 24. The sole structure according to any one of Clauses 3 to 23, wherein a portion of the projection field extends between at least two of the plurality of medial side primary traction elements and/or a portion of the projection field extends between at least two of the plurality of lateral side primary traction elements.

Clause 25. The sole structure according to any preceding Clause, further comprising an intermediate primary traction element located within the projection field.

Clause 26. The sole structure according to any one of Clauses 1 to 24, wherein the projection field is free of primary traction elements.

Clause 27. The sole structure according to any preceding Clause, wherein the projection field is integrally formed with at least one of the parts of the sole member.

Clause 28. The sole structure according to any one of Clauses 1 to 26, wherein the projection field is a separate part engaged with at least one of the parts of the sole member.

Clause 29. The sole structure according to Clause 2, wherein a portion of the projection field extends between at least two of the plurality of primary traction elements on one side of the sole member.

Clause 30. An article of footwear, comprising:

an upper; and a sole structure according to any preceding Clause engaged with the upper.

Clause 31. An article of footwear, comprising:

an upper; and a sole structure engaged with the upper, the sole structure having a ground-facing surface and an upper-facing surface and comprising a sole member made from one or more parts and including a base surface, a medial side, and a lateral side, wherein the sole member includes:

a first sole part, and a projection field engaged with or integrally formed with the first sole part, wherein the projection field comprises a plurality of projections that extend beyond the base surface and have exposed free ends, wherein the plurality of projections includes at least 20 projections having a projection packing density of at least 4 projections per square inch (0.62 projections per square centimeter) in the projection field (e.g., wherein the projection field defines an area of at least 900 $mm^2$ with projections dispersed throughout), wherein a first subset of the plurality of projections have a length of at least 5 mm, and wherein at least a majority of the plurality of projections in the projection field readily bend under force applied by weight of a user of the sole structure.

Clause 32. An article of footwear, comprising:

an upper; and a sole structure engaged with the upper, sole structure having a ground-facing surface and an upper-facing surface and comprising a sole member made from one or more parts and including a base surface, a medial side, and a lateral side, wherein the sole member includes:

a plurality of primary traction elements extending in a direction away from the base surface, wherein each traction element of the plurality of primary traction elements extends from the base surface to a free end surface, and a projection field engaged with or integrally formed with at least one or more parts of the sole member, wherein the projection field comprises a plurality of projections that extend beyond the base surface and have exposed free ends, wherein the plurality of projections includes at least 20 projections in the projection field, wherein at least a majority of the plurality of projections in the projection field readily bend under force applied by weight of a user of the sole structure, and wherein with the sole structure supported on its ground-facing surface on a horizontal support surface, a first subset of the plurality of projections have a longitudinal length when fully extended so that their free ends extend toward the horizontal support surface beyond the free end of a closest primary traction element to the respective projection of the first subset.

Clause 33. An article of footwear, comprising:

an upper;

a sole member made from one or more parts engaged with the upper, the sole member including a ground-contacting member having a base surface, a medial side, and a lateral side;

a plurality of medial side primary traction elements located on the medial side of the sole member and extending in a direction away from the base surface;

a plurality of lateral side primary traction elements located on the lateral side of the sole member and extending in a direction away from the base surface;

a central space defined between interior extents of the plurality of medial side primary traction elements and the plurality of lateral side primary traction elements; and a projection field located at least partially in the central space, wherein the projection field comprises a plurality of projections that extend beyond the base surface and have exposed free ends, wherein the plurality of projections includes at least 20 projections having a projection packing density of at least 4 projections per square inch (0.62 projections per square centimeter) in the projection field (e.g., wherein the projection field defines an area of at least 900 $mm^2$ with projections dispersed throughout), wherein a first subset of the plurality of projections have a length of at least 8 mm, and wherein at least a majority of the plurality of projections in the projection field readily bend under force applied by weight of a user of the article of footwear.

Clause 34. An article of footwear, comprising:

an upper;

a sole member made from one or more parts engaged with the upper, the sole member including a ground-contacting member having a base surface, a medial side, and a lateral side;

a plurality of medial side primary traction elements located on the medial side of the sole member and extending in a direction away from the base surface, wherein each traction element of the plurality of medial side primary traction elements extends from the base surface to a free end surface;

a plurality of lateral side primary traction elements located on the lateral side of the sole member and extending in a direction away from the base surface, wherein each traction element of the plurality of lateral side primary traction elements extends from the base surface to a free end surface;

a central space defined between interior extents of the plurality of medial side primary traction elements and the plurality of lateral side primary traction elements; and a projection field located at least partially in the central space, wherein the projection field comprises a plurality of projections that extend beyond the base surface and have exposed free ends, wherein the plurality of projections includes at least 20 projections in the projection field, wherein at least a majority of the plurality of projections in the projection field readily bend under force applied by weight of a user of the article of footwear, and wherein with the article of footwear supported on its ground-facing surface on a horizontal support surface, a first subset of the plurality of projections have a longitudinal length when fully extended so that their free ends extend toward the horizontal support surface beyond the free end of a closest primary traction element to the respective projection of the first subset.

Clause 35. The article of footwear according to any one of Clauses 31-34, wherein the projection field includes a projection field base having a first surface and a second surface opposite the first surface, and wherein the plurality of projections originate at the second surface and extend from the projection field base in a direction away from the first surface and the second surface.

Clause 36. The article of footwear according to Clause 35, wherein the base surface of the sole member includes an interior surface and an exterior surface opposite the interior surface, wherein the base surface has an opening defined through it that extends completely from the interior surface to the exterior surface, wherein the second surface of the projection field base is engaged with the interior surface of the base surface, and wherein the plurality of projections extend through the opening.

Clause 37. The article of footwear according to Clause 36, wherein the upper includes a bottom component, and wherein a bottom surface of the bottom component is engaged with the first surface of the projection field base.

Clause 38. The article of footwear according to any one of Clauses 35-37, wherein the first surface of the projection field base is planar or smoothly contoured.

Clause 39. The article of footwear according to any one of Clauses 35-38, wherein the projection field is configured in the article of footwear to transmit force incident on the plurality of projections from a ball through the projection field and to a wearer's foot contained in the upper.

Clause 40. The article of footwear according to any one of Clauses 35-39, wherein, with the article of footwear supported on its ground-facing surface in an unloaded condition, the projection field directly contacts a bottom surface of the upper.

Clause 41. The article of footwear according to any one of Clauses 33-40, wherein a portion of the projection field extends between at least two of the plurality of medial side primary traction elements and/or a portion of the projection field extends between at least two of the plurality of lateral side primary traction elements.

Clause 42. The article of footwear according to any one of Clauses 31-41, further comprising an intermediate primary traction element located within the projection field.

Clause 43. The article of footwear according to any one of Clauses 31-41, wherein the projection field is free of primary traction elements.

Clause 44. The article of footwear according to any one of Clauses 31-43, wherein the projection field is integrally formed with at least one of the parts of the sole member.

Clause 45. The article of footwear according to any one of Clauses 31-43, wherein the projection field is a separate part engaged with at least one of the parts of the sole member.

Clause 46. The article of footwear according to Clause 32, wherein a portion of the projection field extends between at least two of the plurality of primary traction elements on one side of the sole member.

Clause 47. A sole structure having a ground-facing surface and an upper-facing surface, the sole structure comprising:

a sole member made from one or more parts and including a base surface, a medial side, and a lateral side;

a plurality of medial side primary traction elements located on the medial side of the sole member and extending in a direction away from the base surface;

a plurality of lateral side primary traction elements located on the lateral side of the sole member and extending in a direction away from the base surface;

a central space defined between interior extents of the plurality of medial side primary traction elements and the plurality of lateral side primary traction elements; and a projection field located at least partially in the central space, wherein the projection field comprises a plurality of projections, wherein a first subset of projections of the plurality of projections have a combination of two or more of the parameter values set forth in Table 1.

Clause 48. The sole structure according to Clause 47, wherein the projection field and/or the first subset of projections further include one or more of the parameter values set forth in Table 3.

Clause 49. A sole structure having a ground-facing surface and an upper-facing surface, the sole structure comprising:

a sole member made from one or more parts and including a base surface, a medial side, and a lateral side;

a plurality of medial side primary traction elements located on the medial side of the sole member and extending in a direction away from the base surface;

a plurality of lateral side primary traction elements located on the lateral side of the sole member and extending in a direction away from the base surface;

a central space defined between interior extents of the plurality of medial side primary traction elements and the plurality of lateral side primary traction elements; and a projection field located at least partially in the central space, wherein the projection field comprises a plurality of projections, wherein a first subset of projections of the plurality of projections have a combination of two or more of the parameter values set forth in Table 2.

Clause 50. The sole structure according to Clause 49, wherein the projection field and/or the first subset of projections further include one or more of the parameter values set forth in Table 3.

Clause 51. A sole structure having a ground-facing surface and an upper-facing surface, the sole structure comprising:

a sole member made from one or more parts and including a base surface, a medial side, and a lateral side;

a plurality of medial side primary traction elements located on the medial side of the sole member and extending in a direction away from the base surface;

a plurality of lateral side primary traction elements located on the lateral side of the sole member and extending in a direction away from the base surface;

a central space defined between interior extents of the plurality of medial side primary traction elements and the plurality of lateral side primary traction elements; and a projection field located at least partially in the central space, wherein the projection field comprises a plurality of projections, wherein the projection field and/or a first subset of projections of the plurality of projections have a combination of two or more of the parameter values set forth in Table 3.

Clause 52. The sole structure according to Clause 51, wherein the first subset of projections further include one or more of the parameter values set forth in Table 1.

Clause 53. The sole structure according to Clause 51, wherein the first subset of projections further include one or more of the parameter values set forth in Table 2.

Clause 54. An article of footwear, comprising:

an upper; and a sole structure according to any one of Clauses 47-53 engaged with the upper.

Clause 55. The article of footwear according to Clause 54, wherein the projection field includes a projection field base having a first surface and a second surface opposite the first surface, and wherein the plurality of projections originate at the second surface and extend from the projection field base in a direction away from the first surface and the second surface.

Clause 56. The article of footwear according to Clause 55, wherein the base surface of the sole member includes an interior surface and an exterior surface opposite the interior surface, wherein the base surface has an opening defined through it that extends completely from the interior surface to the exterior surface, wherein the second surface of the projection field base is engaged with the interior surface of the base surface, and wherein the plurality of projections extend through the opening.

Clause 57. The article of footwear according to Clause 56, wherein the upper includes a bottom component, and wherein a bottom surface of the bottom component is engaged with the first surface of the projection field base.

Clause 58. The article of footwear according to any one of Clauses 55-57, wherein the first surface of the projection field base is planar or smoothly contoured.

Clause 59. The article of footwear according to any one of Clauses 39, 55-58, wherein the projection field is configured in the article of footwear to transmit force incident on the plurality of projections from a ball through the projection field and to a wearer's foot contained in the upper.

Clause 60. The article of footwear according to any one of Clauses 55-59, wherein, with the article of footwear supported on its ground-facing surface in an unloaded condition, the projection field directly contacts a bottom surface of the upper.

What is claimed is:

1. A sole structure, comprising:

a sole member including a base surface, a medial side, and a lateral side, wherein the sole member includes a first sole part and a projection field, wherein the projection field comprises a separate part that is engaged with the first sole part, wherein the first sole part includes an interior surface and an exterior surface opposite the interior surface, wherein an opening is defined through the first sole part, wherein the opening extends completely through the first sole part from the interior surface to the exterior surface, wherein the projection field comprises a plurality of projections that extend beyond the base surface and have exposed free ends, wherein the plurality of projections includes at least 20 projections having a projection packing density of at least 4 projections per square inch in the projection field, wherein a first subset of the plurality of projections includes at least a majority of the projections in the projection field, wherein the first subset of the plurality of projections have a longitudinal length of at least 10 mm and readily bend under force applied by weight of a user of the sole structure, wherein the projection field includes a projection field base having a first surface and a second surface opposite the first surface, wherein the plurality of projections originate at the second surface and extend from the projection field base in a direction away from the first surface and the second surface, and wherein the second surface of the projection field base is engaged with the interior surface of the first sole part, wherein the plurality of projections extend through the opening, wherein at least a majority of the projection field is located in a forefoot region of the sole structure, and wherein the projection field is located forward of a heel region of the sole structure; and a plurality of primary traction elements extending in a direction away from the base surface, wherein each traction element of the plurality of primary traction elements extends from the base surface to a free end surface, and wherein with a bottom of the sole structure supported on a horizontal support surface, the longitudinal lengths of the first subset of the plurality of projections are sufficient so that the free ends of the first subset of the plurality of projections extend toward the horizontal support surface beyond the free end surface of a closest primary traction element to a respective projection of the first subset.

2. The sole structure according to claim 1, wherein the plurality of primary traction elements includes:

a plurality of medial side primary traction elements located on the medial side of the sole member and extending in the direction away from the base surface; and a plurality of lateral side primary traction elements located on the lateral side of the sole member and extending in the direction away from the base surface;

wherein a central space is defined between the plurality of medial side primary traction elements and the plurality of lateral side primary traction elements, and wherein the projection field is located at least partially in the central space and extends continuously from the forefoot region to a midfoot region of the sole structure.

3. The sole structure according to claim 1, wherein the plurality of primary traction elements includes:

a plurality of medial side primary traction elements located on the medial side of the sole member and extending in the direction away from the base surface;

a plurality of lateral side primary traction elements located on the lateral side of the sole member and extending in the direction away from the base surface;

wherein a central space is defined between the plurality of medial side primary traction elements and the plurality of lateral side primary traction elements, and wherein the projection field is located at least partially in the central space.

4. The sole structure according to claim 1, wherein the opening has a size of at least 2500 $mm^2$.

5. The sole structure according to claim 4, wherein a matrix structure extends across the opening to divide the opening into a plurality of openings separated by the matrix structure, and wherein the second surface of the projection field base contacts an interior surface of the matrix structure.

6. The sole structure according to claim 1, wherein an area of the projection field is at least 2400 $mm^2$.

7. The sole structure according to claim 1, wherein the projection field extends continuously from the forefoot region to a midfoot region of the sole structure.

8. The sole structure according to claim 1, wherein at least 20 projections of the plurality of projections have a largest transverse cross sectional dimension of 8 mm or less.

9. The sole structure according to claim 1, wherein at least 20 projections of the plurality of projections have a largest transverse cross sectional dimension of 5 mm or less.

10. The sole structure according to claim 1, wherein the projection field is free of primary traction elements.

11. The sole structure according to claim 1, wherein the projection field includes at least 50 projections, and wherein the projection packing density of at least 4 projections per square inch is present over a projection field area of at least 900 $mm^2$.

12. The sole structure according to claim 1, wherein the projection field includes at least 50 projections, and wherein the projection packing density is at least 6 projections per square inch present over a projection field area of at least 900 $mm^2$.

13. The sole structure according to claim 1, wherein the projection field includes at least 50 projections, and wherein the projection packing density is at least 8 projections per square inch present over a projection field area of at least 900 $mm^2$.

14. The sole structure according to claim 1, wherein at least 20 projections of the plurality of projections have a polygonal transverse cross sectional shape with a largest polygon side dimension of 8 mm or less.

15. A sole structure, comprising:

a sole part including an interior surface and an exterior surface opposite the interior surface, wherein an opening is defined through the sole part, wherein the opening extends completely through the sole part from the interior surface to the exterior surface;

a projection field including: (i) a projection field base engaged with the interior surface of the sole part and (ii) a plurality of projections that extend from the projection field base and through the opening, wherein the plurality of projections includes at least 20 projections having a projection packing density of at least 4 projections per square inch in the projection field, wherein a first subset of the plurality of projections includes at least a majority of the projections in the projection field, wherein the first subset of the plurality of projections have a longitudinal length of at least 10 mm and readily bend under force applied by weight of a user of the sole structure, wherein at least a majority of the projection field is located in a forefoot region of the sole structure, and wherein the projection field is located forward of a heel region of the sole structure; and a plurality of outer edge primary traction elements, wherein the projection field is at least partially contained within an area defined by the plurality of outer edge primary traction elements, wherein each traction element of the plurality of outer edge primary traction elements extends to a free end surface, and wherein with a bottom of the sole structure supported on a horizontal support surface, the longitudinal lengths of the first subset of the plurality of projections are sufficient so that the free ends of the first subset of the plurality of projections extend toward the horizontal support surface beyond the free end surface of a closest outer edge primary traction element to a respective projection of the first subset.

16. The sole structure according to claim 15, wherein the projection field includes at least 50 projections, and wherein the projection packing density of at least 4 projections per square inch is present over a projection field area of at least 900 $mm^2$.

17. The sole structure according to claim 15, wherein the projection field includes at least 50 projections, and wherein the projection packing density is at least 6 projections per square inch present over a projection field area of at least 900 $mm^2$.

18. The sole structure according to claim 15, wherein the projection field includes at least 50 projections, and wherein the projection packing density is at least 8 projections per square inch present over a projection field area of at least 900 $mm^2$.

* * * * *